US007328730B2

(12) United States Patent
Vilalta et al.

(10) Patent No.: US 7,328,730 B2
(45) **Date of Patent: *Feb. 12, 2008**

(54) FOOD STORAGE CONTAINERS

(75) Inventors: Montserrat Vilalta, Barcelona (ES); Jose Millan, Barcelona (ES); Juan Carlos Coronado, Barcelona (ES); Mariano Penaranda, Barcelona (ES); Antonio Rebordosa, Sant Fruitos de Bages (ES); Sergi Gili, Barcelona (ES); Robert Rafols, Barcelona (ES); Wolfgang Vorbeck, Idstein (DE); Helmut Franke, Wehrheim (DE); Alejandro Hernandez, Tarragona (ES)

(73) Assignee: Braun GmbH, Kronberg (DE)

( * ) Notice: Subject to any disclaimer, the term of this patent is extended or adjusted under 35 U.S.C. 154(b) by 368 days.

This patent is subject to a terminal disclaimer.

(21) Appl. No.: 10/882,551

(22) Filed: Jul. 1, 2004

(65) Prior Publication Data

US 2005/0061813 A1 Mar. 24, 2005

Related U.S. Application Data

(63) Continuation-in-part of application No. PCT/DE03/03430, filed on Oct. 16, 2003, and a continuation-in-part of application No. 10/457,319, filed on Jun. 9, 2003, now Pat. No. 7,096,893, which is a continuation-in-part of application No. PCT/EP01/13147, filed on Nov. 14, 2001, and a continuation-in-part of application No. PCT/EP01/13234, filed on Nov. 15, 2001.

(30) Foreign Application Priority Data

Dec. 8, 2000 (DE) ..... 100 60 996
Dec. 8, 2000 (DE) ..... 100 60 998

(51) Int. Cl.
*B65B 39/00* (2006.01)

(52) U.S. Cl. ..... 141/326; 141/8; 141/65; 141/325; 206/524.8; 215/262; 220/203.11; 220/231

(58) Field of Classification Search ..... 220/321, 220/367.1, 254.3, 203.05, 203.11, 212; 215/260, 215/262, 230; 206/524.8; 116/270; 141/8, 141/65, 325, 326; 99/472
See application file for complete search history.

(56) References Cited

U.S. PATENT DOCUMENTS 2,130,180 A 9/1938 Evans
2,634,014 A 4/1953 Kimber (Continued)

FOREIGN PATENT DOCUMENTS

CH 3 04 374 3/1955

(Continued)

*Primary Examiner*—Timothy L. Maust
(74) *Attorney, Agent, or Firm*—Fish & Richardson P.C.

(57) ABSTRACT

A food storage container includes a lid with a vent hole, and a removable cover removably secured to the lid to cover the vent hole. The cover has an evacuation hole. The food storage container further includes a one-way air valve disposed between the vent hole and evacuation hole. When the cover is secured to the lid, the one-way air valve inhibits air flow into the container through the vent hole, and when the cover is not secured to the lid, the one-way air valve allows air flow into the container.

44 Claims, 17 Drawing Sheets

U.S. PATENT DOCUMENTS

| | | | |
|---|---|---|---|
| 2,655,894 | A | 10/1953 | Milton |
| 3,241,514 | A | 3/1966 | Grimland |
| 3,737,066 | A | 6/1973 | Ames |
| 4,016,999 | A | 4/1977 | Denzer |
| 4,051,971 | A | 10/1977 | Saleri et al. |
| 4,674,642 | A | 6/1987 | Towns |
| 4,778,072 | A | 10/1988 | Newman |
| 4,793,717 | A | 12/1988 | Manske |
| 4,838,772 | A | 6/1989 | LeBlanc |
| 5,137,424 | A | 8/1992 | Daniel |
| 5,195,427 | A | 3/1993 | Germano |
| 5,277,876 | A | 1/1994 | Wagner |
| 5,279,550 | A | 1/1994 | Habib et al. |
| 5,465,857 | A | 11/1995 | Yang |
| 5,735,317 | A | 4/1998 | Wu |
| 5,762,228 | A | 6/1998 | Morgan et al. |
| 5,779,082 | A | 7/1998 | Miramon |
| 5,803,282 | A | 9/1998 | Chen et al. |
| 5,806,703 | A | 9/1998 | Grandi |
| 5,955,127 | A | 9/1999 | Glaser |
| 5,974,686 | A | 11/1999 | Nomura et al. |
| 6,799,506 | B2 | 10/2004 | Tarlow |
| 2004/0173105 | A1 | 9/2004 | Kim et al. |

FOREIGN PATENT DOCUMENTS

| | | |
|---|---|---|
| DE | 74 09 380 | 3/1974 |
| DE | 28 21 852 | 5/1978 |
| DE | 83 21 236 | 7/1983 |
| DE | 41 36 150 | 11/1991 |
| DE | 43 06 171 | 2/1993 |
| DE | 43 34 250 | 10/1993 |
| DE | 43 42 394 | 12/1993 |
| DE | 195 04 638 | 2/1995 |
| DE | 299 20 316 | 11/1999 |
| DE | 100 60 998 | 12/2000 |
| DE | 100 60 999 | 12/2000 |
| EP | 0 234 607 | 9/1987 |
| EP | 0 633 196 | 1/1995 |
| EP | 0 644 128 | 3/1995 |
| EP | 0 820 939 | 1/1998 |
| FR | 2 235 064 | 6/1973 |
| FR | 2 692 870 | 6/1992 |
| GB | 2 317 882 | 4/1998 |
| JP | 07 277 374 | 10/1995 |
| RU | 2 089 087 | 9/1997 |
| RU | 2089087 | 9/1997 |
| WO | WO88/00560 | 1/1988 |
| WO | WO91/08151 | 6/1991 |
| WO | WO97/17259 | 5/1997 |
| WO | WO02/46057 | 6/2002 |

FOOD STORAGE CONTAINERS

CROSS-REFERENCE TO RELATED APPLICATIONS

This application is a continuation-in-part of PCT application PCT/DE03/03430, filed on Oct. 16, 2003, and of U.S. patent application Ser. No. 10/457,319, filed on Jun. 9, 2003 now U.S. Pat. No. 7,096,893, and entitled "Food Storage Containers", which is a continuation-in-part of PCT applications PCT/EP01/13147, filed on Nov. 14, 2001, and PCT/EP01/13234, filed on Nov. 15, 2001, and which claims priority under 35 U.S.C. § 119(a) from German patent applications DE 100 60 998.8 and DE 100 60 996.1, both filed on Dec. 8, 2000. The entire contents of all of the above cross-referenced applications are herein incorporated by reference.

TECHNICAL FIELD

This invention relates to sealable food storage containers.

BACKGROUND

Food storage systems can allow food to be preserved under better conditions than if the food were stored without such systems. One way to improve the storage of food is to keep it in a container under vacuum. Such systems have been shown to produce very good results in protecting food from certain microorganisms, pests, mold and fungus growth. Furthermore, they help to prevent the food from oxidizing, maintaining the moisture level and aroma of the food.

Lids for storage containers can include a venting or aerating valve for the equalization of pressure during heating in a microwave oven.

EP 0 633 196 A2 describes such a lid. The objective of EP 0 633 196 A2 is to prevent the build-up of overpressure in the interiors of food storage containers that are heated in a microwave oven. The build-up of overpressure tends to occur when there are aqueous liquids in a container interior. The liquids can evaporate during heating, thereby building up an overpressure in the interior of the container. This is a disadvantage particularly when opening the container lid because it can cause sauces or other food items to spurt out suddenly when the lid is opened. EP 0 633 196 A2 proposes a venting valve in the lid of the food storage container. The venting valve is to be opened before the container is placed in the microwave oven. Water vapor developing during the heating operation can then escape unhindered through the valve without a corresponding build-up of vapor pressure in the interior of the sealed container.

The objective of EP 0 820 939 A1 also is the prevention of the build-up of overpressure in the interiors of food storage containers that are heated in a microwave oven. In other words, the objective is to provide food storage containers with venting capability, in order to be able to safely heat in a microwave oven the food stored inside of the containers, with the container lid closed. Unlike EP 0 633 196 A2, a valve mechanism is described which can be opened byway of a joint like a rocker. Hence all that is required is to press in the rocker lever for the valve to open with ease.

WO 88/00560 describes an opening mechanism for a plastic beverage can. By opening a venting valve, the pressure can be equalized, thereby making it easier to subsequently open and pull off the entire lid. The lids in WO 88/00560 invariably are plastic lids, because an objective is to avoid the use of metal lids. In particular, the equalization of overpressure in the interior of the container resulting from carbonated beverages, for example, plays a role in this case.

Further, U.S. Pat. No. 3,737,066 discloses a container devised preferably for the storage of liquids. The side walls of the container are made of a coated carton material, and the base and lid elements of the container are comprised of plastic plates connected with the carton walls in a liquid-tight relationship. The upper plastic lid has a reclosable opening mechanism which is also made of plastic and is positively engaged with the lid by holding pins. No provision is made for venting prior to opening the container lid or for a device for pressure equalization.

CH 304 374 discloses a closure lid for an aluminum sterilizing container. The lid has an essentially circular-ring-shaped configuration, and it is mounted on a cylindrical aluminum container. A rubber seal is placed between the edge of the lid and the upper brim of the container. Provided in the middle of the container lid is an additional opening which is covered by a rubber cap. The rubber cap provides a visual check, indicating whether there is a vacuum inside the container. As long as the pressure inside the container is adequately below atmospheric pressure, the rubber cap bulges inward a corresponding amount. This bulge diminishes continually as the vacuum decreases. Hence it is difficult for the observer to decide whether the pressure level inside the container is adequate for ensuring the freshness of the food inside the container.

Another container evacuation system is described in U.S. Pat. No. 5,195,427. U.S. Pat. No. 5,195,427 describes a vacuum container for storing food that is sealable in an airtight manner by a cover. A valve formed in a flow channel and functioning as a non-return valve is also located in the cover, as already described. The difference with respect to the previously described related art is essentially only that an electric vacuum pump held in the hand of an operator is used in the system, instead of a manually operated vacuum pump. To evacuate the container space, the pump is positioned or coupled in a sealing manner at the suction opening of the cover. The container evacuation system described in U.S. Pat. No. 5,195,427 can result in, as described above, an undesirably high vacuum being created in the container space. In some cases, an undesirably high vacuum can adversely affect the storage life of food in the container. The vacuum pump described in U.S. Pat. No. 5,195,427 can also transport liquid food, for example, when the suction connection is submerged in water, cream, etc., and is then activated.

EP 0 234 607 B1 describes a bottle closure which also serves as a vent valve. A cylindrical vacuum pump is connected thereto, such that it fully encompasses the projecting cylindrical shank of the bottle closure.

EP 0 644 128 A1 describes a sealable container adapted to be evacuated by a vacuum pump. A one-way valve is received in a cylindrical depression in the container lid, and the suction opening of a vacuum pump is inserted therein. The annular periphery of the depression forms a sealing surface adapted to sealingly engage with a manually operable vacuum pump.

In accordance with FIG. 5 of EP 0 644 128 A1, if air is evacuated from the container space via the vacuum pump, then the non-return valve opens, and air flows from the container space through the valve into the vacuum pump. During the next idle stroke, after a non-return valve in the vacuum pump is closed, the air is transported outward to the atmosphere. The non-return valve in the cover closes as soon as the pressure in the container space is less than either the pressure in the vacuum pump or the atmospheric pressure. However, the non-return valve in the cover is also closed in the presence of atmospheric pressure in the container space as well as in the environment. The non-return valve opens as soon as the pressure in the vacuum pump is less than the pressure in the container space.

The non-return valve in the cover is formed by a diaphragm that is elastically prestressed in its initial position so that the diaphragm blocks the flow path when the diaphragm is in the rest state. If there is a sufficient vacuum in the container space, which is evidenced by the pump becoming increasingly difficult to operate, then an operator can separate the suction connection of the vacuum pump from the suction connection in the cover. This is possible because after every stroke of the vacuum pump, the non-return valve closes again so that no appreciable suction action results at the coupling connection.

In this manner, food that is located in the container space may be preserved longer than would be the case under atmospheric pressure. In the evacuated state, the cover can no longer be separated from the container because the force on the sealing surface between the cover and container is too great, due to the existing pressure difference. As a result, in order to subsequently open the container to remove the food, the vacuum in the container space must first be removed. This is achieved by manually pulling on a pin formed on the sealing sleeve until the sealing surface of the valve lifts away from the valve seat. Accompanied by hissing noises, atmospheric air is now able to flow into the container space until the pressure in the atmosphere and the pressure container space are equalized. After the pressure has been equalized, the cover can be easily removed from the container, and food can be removed from the container.

The arrangement described in EP 0 644 128 A1 can result in different vacuum pressures being produced in the container space via the manually operated vacuum pump, depending on the force exerted by an operator, and on the number of strokes that are completed at the vacuum pump. If in this process the vacuum becomes too strong in the container space, then bacteria that can attack the food can form in the container space. In fact, practice has shown that optimal storage life values may only be achieved within a certain pressure range in the container space. The arrangement described in EP 0 644 128 A1 can also result in other media (e.g. water) being transported by the vacuum pump, which can contaminate the food.

In DE-74 09 380 U, a food storage container includes a filling opening which is closable by a lid. At its center, the lid has a vent opening which is closable by a valve element. The valve element has an opening lug which allows the valve element to be lifted off the vent opening, thus enabling the vacuum existing inside the storage container to be reduced. After cooking, a vacuum can be obtained in the storage container by allowing the food to cool with the valve closed.

Furthermore, in DE-28 21 852 A1, a food storage container is closable air-tight by a lid equipped with a valve. The valve is arranged at the center of the lid and is surrounded by an annular connecting device on which a vacuum pump for venting the food space of the storage container is mountable. To release the vacuum, the valve disk must be manually lifted to break the seal against the lid, such as by prying the disk upward with a knife or other tool.

To generate a vacuum in a food storage container, a device can be used to draw air out of the container. A wide variety of pumps for performing this function are known from the art. As a rule the pumps intended for household use are based on piston pumps or ventilators.

U.S. Pat. No. 5,195,427 and WO 97/17259 both describe vacuum pumps for evacuating food storage containers. In each specification, conically extending suction tips are inserted in corresponding valve openings in a storage container lid. U.S. Pat. No. 5,195,427 discloses a prior-art electrically powered handheld vacuum pump for use in the household. The handheld device is constructed from a multiplicity of single parts for use solely as a vacuum pump. In particular, the shaft's rotary motion is elaborately converted into an oscillating motion. A suitable reduction gear drives the piston pump. The system is intended for the evacuation of food storage containers. With this device, it is possible to easily obtain a suitable pressure ratio for storing food in a vacuum container.

DE 195 04 638 A1 discloses an immersion blender for mixing or comminuting food. The blender includes a blade which rotates in a bell-shaped recess, thereby generating a vacuum. The vacuum that accumulates in the bell serves to improve and intensify the mixing of food.

In 299 20 316 U1, a device generates a vacuum in a container by using a vacuum-cleaner as a vacuum generator. An adapter piece in the form of an attachment to a vacuum-cleaner is mountable on a valve arranged on the container lid.

SUMMARY

In one aspect, the invention features a food storage container including a lid with a vent hole through it. The food storage container also includes a removable cover removably secured to the lid to cover the vent hole. The cover has an evacuation hole through it. The lid further includes a one-way air valve located between the vent hole and the evacuation hole. When the cover is secured to the lid, the one-way air valve inhibits air flow into the container through the vent hole. When the cover is not secured to the lid, the one-way air valve allows air flow into the container.

The food storage container of the invention can be easy and economical to manufacture. The construction of the food storage container can make it unnecessary to have to center the vacuum pump.

In certain embodiments, the one-way air valve allows bi-directional air flow through the vent hole when the cover is not secured to the lid.

In some embodiments, the outer surface of the cover has a smooth sealing area extending about the evacuation hole. The sealing area can be used for sealing against a vacuum pump held against the cover over the evacuation hole, to evacuate the container.

In some embodiments, the one-way air valve includes a sealing tab. An advantage to this is that an integrated component with few individual parts can be provided as a result. In other words, once the storage container is evacuated, sealing can take place automatically by the sealing tab being drawn against the vent hole in the container lid.

The one-way air valve can be a flapper valve.

In some cases, the cover has a driving element. One end of the driving element is connected to the one-way air valve (e.g., to the sealing tab), while another end of the driving element extends through the cover. This embodiment can provide a surprisingly simple design solution for opening the container lid with ease because to begin with the sealing tab can be lifted off the vent hole by pulling open the cover by way of the driving element. This can result in pressure equalization between the interior of the container and the surroundings. The container lid can now no longer be drawn by the vacuum in the interior of the storage container and can be lifted off it with ease.

In certain embodiments, the end of the driving element that extends through the cover has a rim that can come into contact with a surface of the cover when the cover is lifted away from the lid.

There can be a ventilation channel in the lid. In some embodiments, the cover includes a sealing journal that closes the ventilation channel when the cover is removed from the lid, so that air can flow into the container through the ventilation channel when the cover is removed from the lid.

The food storage container can further include a sealing sleeve with a sealing tongue, and the sealing sleeve can be located between the cover and the lid when the cover is secured to the lid. In some embodiments, the sealing tongue closes the vent hole when the cover is secured to the lid. In embodiments in which the lid has a ventilation channel in it, the ventilation channel can be located beneath a conical recess in the sealing sleeve when the cover is secured to the lid.

In certain embodiments, the food storage container further includes a pressure-indicating protrusion that extends through a bore in the cover. The pressure-indicating protrusion can include a one-piece diaphragm. In some embodiments, the pressure-indicating protrusion can include a pressure-indicating plug at one end of the one-piece diaphragm.

The food storage container can include a pressure indicator located in a recess defined by the lid. An advantage to this embodiment is that the evacuation operation can be simplified because the user can immediately see when a sufficient vacuum is attained inside the storage container. Integrating this feature in the food storage container can result in a multi-function component.

The pressure indicator can extend through an opening in the cover. The pressure indicator can include a dome-shaped membrane. An advantage to this is that the pressure indicator can be visually and haptically detectable. The visual impact of the membrane, which can be made of an elastomeric plastic material, for example, can be increased by designing it accordingly in a signal color. The membrane can have a tactile effect, which can enable even users with poor vision to determine the condition of pressure inside the storage container. This tactile effect can be achieved according to the degree by which the pressure indicator projects beyond, or disappears within, the outer contour of the cover under the corresponding pressure conditions.

The dome-shaped membrane can have a resilient layer disposed on an interior surface of the membrane. The dome-shaped membrane can include a spring element that causes the pressure indicator to snap back into its initial position in the presence of a predetermined pressure. An advantage of this is that the pressure indicator can thereby adopt an unmistakable signal position. When there is ambient pressure inside the storage container, the membrane of the pressure indicator can project distinctly outward. When a pre-defined pressure below atmospheric is attained inside the container, the membrane can "snap" inward. With the spring suitably selected, the membrane can be guaranteed to snap back into its initial position when a minimum pressure below atmospheric is exceeded inside the storage container. In other words, in some cases there are only two unmistakable positions of the pressure indicator: sufficient pressure below atmospheric inside the storage container (the pressure indicator is snapped in), and insufficient pressure below atmospheric or ambient pressure (the pressure indicator is in its initial position).

The spring element can be formed, for example, by selecting a suitable resilient plastic material for the membrane of the pressure indicator or by inserting a spring metal in the membrane of the pressure indicator.

In some cases, the pressure indicator includes a plastic resin that can maintain dimensional stability of the membrane over a temperature range of between about −40° C. and about 100° C. An advantage of this is that the storage container and its contents can be stored in a deep-freezer and then defrosted in a microwave oven. The vent hole can be opened by way of the cover when heating the food storage container in the microwave oven. Possible materials for the pressure indicator can be polypropylene and polyamide as well as any other temperature-resistant and taste-neutral plastic material.

In some embodiments, the lid and the cover are integrally joined to each other. In some cases, the lid is connected to the cover by a hinge (e.g., a film hinge). In this case the material of the lid and/or cover can be selected for sufficient stiffness, as well as necessary sealing properties. Advantages to this embodiment can be economy of manufacture as an injection molding, and ease of mounting on the storage container. Furthermore, it can be possible to manufacture the container lid and the cover as a joint injection molding. The sealing tab and the membrane of the pressure indicator can be made of an elastic elastomeric plastic or rubber material, which can then be inserted in the component made up of the container lid and the cover. The fact that the cover can be used not only to open the vent opening, but also to lift the entire container lid via the film hinge, is a further advantage.

In another aspect, the invention features a food storage container including a container body with a vent hole. The food storage container also includes a removable cover removably secured to the container body to cover the vent hole. The cover has an evacuation hole through it. A one-way air valve is disposed between the vent hole and evacuation hole. With the cover secured to the container body, the one-way air valve inhibits air flow into the container through the vent hole while allowing air flow out of the container via the vent hole and evacuation hole. With the cover removed from the container body, the one-way air valve allows bi-directional air flow through the vent hole. An outer surface of the cover has a smooth sealing area extending about the evacuation hole for sealing against a vacuum pump held against the cover over the evacuation hole to evacuate the container.

In an additional aspect, the invention features a method for evacuating a food storage container. The method includes attaching a vacuum pump attachment to a handheld electric appliance with an electric motor operable to drive a shaft, such that the shaft is mechanically coupled to a drive of the vacuum pump to pump air. The vacuum pump includes a housing with a rim about an air inlet. The method further includes coupling the vacuum pump to a food storage container. The food storage container includes a lid with a vent hole through it. The food storage container also includes a removable cover removably secured to the lid to cover the vent hole. The cover has an evacuation hole through it. The lid further includes a one-way air valve located between the vent hole and the evacuation hole. With the cover secured to the lid, the one-way air valve inhibits air flow into the container through the vent hole while allowing air flow out of the container via the vent hole and evacuation hole. With the cover removed, the one-way air valve allows bi-directional air flow through the vent hole. An outer surface of the cover has a smooth sealing area extending about the evacuation hole. The sealing area seals against a vacuum pump held against the cover over the evacuation hole to evacuate the container. The vacuum pump is coupled to the food storage container by placing the rim of the vacuum pump housing against an outer surface of the storage container, about the evacuation hole. The method further includes activating the vacuum pump to evacuate air from the container through the one-way valve, and then removing the vacuum pump from the container.

An advantage of this method is that it can be easy and quick to perform. The low requirements imposed on the user by the method can make it especially suitable for the household sector. In some cases, no elaborate centering is needed prior to the evacuation operation.

In some embodiments, placing the rim of the vacuum pump housing against an outer surface of the storage container includes placing the rim of the vacuum pump housing against the cover.

In some embodiments, the vacuum pump attachment is attached to the handheld electric appliance before the vacuum pump is activated. In some cases the handheld electric appliance is a motorized handle of an immersion blender, and the method includes, prior to attaching the vacuum pump attachment to the handheld electric appliance, removing a blending attachment from the motorized handle.

In a further aspect, the invention features a storage container evacuation pump. The evacuation pump includes a handheld electric appliance having an electric motor operable to drive a shaft, and a pump attachment. The pump attachment has a vacuum pump housing with a sealing lip about an air inlet of the pump attachment. The pump attachment also has a pump element located within the vacuum pump housing. The pump attachment is releasably coupled to the appliance. The shaft of the appliance operably engages the pump element. The appliance is removable from the pump attachment for powering other attachments.

The pump attachment can provide a small, low-cost and easy-to-use vacuum pump for household applications. In some cases, there is no need for a completely new household appliance and equivalent additional storage space. The attachment can add a further useful component to already existing attachments such as mixers, blenders, etc. This can be a particularly space-saving solution, and far cheaper than an additional electric appliance with its own drive. Furthermore, the attachment can be easy and safe to use in the domestic field. The attachment can be a simple and economical solution. The attachment can simply be plugged into the handheld electrical appliance by, e.g., spur-toothed gears.

In some cases, the pump element has a rotor disposed within a ring (e.g., a graphite ring). The rotor can include vanes that are slidably disposed within slots of the rotor. This type of pump element can feature a higher suction power relative to other vacuum pumps used for domestic applications. The overall height of the pump element can be small because there may be no need of any elaborate rod mechanisms and gears. The pump element can be directly driven with the rotational frequency of the drive shaft of the household appliance. This can also reduce the number of components, which can have a positive effect in turn on the costs of manufacture. Finally, it can take just a few seconds with such a pump element to generate the required level of pressure in a food container.

The sealing lip can be a circumferential sealing, and can be suited for seating engagement with a connecting arrangement. The sealing lip can be formed by a circumferential edge of elastomeric plastic material. The cross-section of the sealing lip can widen toward its free end. This can make it easier for the attachment to be mounted on a suitable valve of a food storage container. The attachment may not need to be located centrally relative to a corresponding valve opening. The sealing lip can work like a suction cup.

In some cases, the attachment includes at its input end a plug-in shank adapted to be slid onto the conical output end of a household electrical appliance. The result can be a simple and low-cost plug-type connection with a handheld household appliance such as an immersion blender. This plug-type connection can be very sturdy and at the same time can serve as a centering arrangement for connecting the shaft couplings of the attachment and the household appliance.

The pump can further include a float section located between the pump element and the sealing lip and fluidly connected to the pump element by a suction pipe. The float section can include a float housing with a bar at one end for engaging a groove of the sealing lip, and defining suction slots at the end including the bar. A float is disposed within the float housing. The float housing can be adapted to limit the entry of liquid into the pump element.

This float section can provide an additional safety function by preventing liquid from entering the pump chamber during the evacuation operation. The solution can be simple and low-cost. For example, it can be possible to provide a simple spherical float in a riser, which floats on the liquid surface and closes a valve opening when the liquid has reached a predetermined level.

In some embodiments, the rotor further includes graphite fibers. Temperature resistance within the operating range can thereby be assured. In addition to this, the occurring centrifugal forces can be withstood without any deformations of unacceptable magnitude. This can also be promoted by the material-related light-weight construction.

In some cases, the vanes include graphite. In this arrangement, the vanes can be configured, for example, as rectangular plates that can be freely movable, actuated solely by centrifugal force, or exposed to spring pressure. By suitable material selection, a self-lubricating, maintenance-free construction can be made available.

In some embodiments, the attachment includes a thermoplastic (for example, polyethylene, polypropylene, or polyamide). This choice of material can represent a cheap, hygienic construction that can enable a multiplicity of designs.

The pump element can be a vane pump.

In some cases, the shaft of the appliance includes a first spur-toothed gear, and the first spur-toothed gear is releasably coupled to a second spur-toothed gear of the pump attachment.

Embodiments of the invention can include one or more of the following advantages.

The valve can allow a food storage container to be easily evacuated and subsequently reopened.

The vacuum pump of the attachment can be rendered temperature-resistant in its operating range. A self-lubricating effect can also be achieved thereby. The vacuum pump can display low pressure losses and/or require no maintenance.

The attachment can provide a small, low-cost and easy-to-use vacuum pump for household use. The attachment can prevent a user from having to purchase a new household appliance, and from having to procure additional storage space for the new appliance. Furthermore, the attachment can be relatively safe to use. The smooth outer walls of the immersion blender and the attachment (made of, e.g., thermoplastic material) can make it easy to clean the equipment combination.

In another aspect, the invention features a container evacuation system that includes a container and a container evacuation pump. The container has a housing defining an interior volume of the container, and a container cover that is disposed on the housing. The cover includes a first non-return valve, a valve cover disposed over the first non-return valve, and a protrusion (e.g., a pin or a journal) extending from a surface of the valve cover. The container evacuation pump has a housing, at one end of which is a connector that includes a connector control valve (e.g., a flapper valve or a disc valve). The connector can couple with the protrusion that extends from the surface of the valve cover, and establish fluid communication between the container evacuation pump and the container.

In some embodiments, the connector can include a connector sealing surface that is in the shape of a truncated cone. The container cover can have a cover sealing surface that is in the shape of a conical recess, and that can couple with the connector sealing surface (e.g., in a pressure-tight manner). The connector sealing surface and/or the cover sealing surface can include an elastomer.

In some embodiments, the container evacuation pump can be driven by an electric drive unit that includes an electric motor and a drive shaft that are connected to each other. In certain embodiments, the drive shaft of the electric drive unit can be coupled with a drive shaft of the container evacuation pump.

The protrusion can have a flow channel in it. The protrusion can include a protrusion control valve located at an outlet of the flow channel. In some embodiments, the protrusion control valve can open during coupling between the protrusion and the connector. The protrusion control valve can be disposed above the first non-return valve. The protrusion control valve and the first non-return valve can be closed after evacuation of the interior volume of the container. The protrusion control valve can include a second non-return valve.

In some embodiments (e.g., embodiments in which the protrusion includes a pin), the protrusion control valve can be formed by a bushing that can slide over an outer surface of the protrusion, such that the bushing closes the outlet of the flow channel. The bushing can be disposed over a spring that can position the bushing to close the outlet of the flow channel.

In certain embodiments, the container evacuation pump can further include a pressure regulating valve that permits only a predetermined level of pressure to be formed in the container. Thus, if the level of vacuum in the container passes the predetermined level, then the regulating valve can automatically open, thereby increasing the pressure in the container and maintaining a constant vacuum within the container. Alternatively or additionally, the container evacuation pump can be configured such that the rotor pump unit has a maximum rotational speed. As a result, the rotor pump unit can generate a fixed vacuum pressure level within the container to a closely defined tolerance.

In embodiments, the control valve may not open until the container evacuation pump is attached to the cover and is opened by the protrusion. As a result, in some embodiments, the evacuation of the container may only be effected by a container evacuation pump that is adapted to couple with the container and to create a predetermined level of vacuum in the container (e.g., a pressure level that is optimal for preserving food within the container). Thus, an insufficient pressure level (e.g., a pressure level that is too high or too low) within the container may be avoided. This is beneficial, for example, because an insufficient level of vacuum within a food storage container can lead to the spoliation of food within the container by exposure to air and/or microbacteria.

The configuration of the container evacuation pump can prevent its misuse (e.g., the configuration of the container evacuation pump may result in the pump being useable only for evacuation of food storage containers). In embodiments, the presence of the connector control valve in the container evacuation pump can prevent media other than air (e.g., food) from being evacuated from the container.

In a further aspect, the invention features a method of using a container evacuation system that includes a container and a container evacuation pump. The container has a housing defining an interior volume of the container, and a container cover that is disposed on the housing. The cover includes a first non-return valve, a valve cover disposed over the first non-return valve, and a protrusion (e.g., a pin or a journal) extending from a surface of the valve cover. The container evacuation pump has a housing, at one end of which is a connector that includes a connector control valve (e.g., a flapper valve or a disc valve). The connector can couple with the protrusion that extends from the surface of the valve cover, and establish fluid communication between the container evacuation pump and the container. The method includes coupling the connector control valve to the protrusion to evacuate the container.

In another aspect, the invention features a storage container evacuation pump that includes a pump housing and a connector disposed at an end of the pump housing. The connector has a suction channel in it and includes a control valve (e.g., a flapper valve or a disc valve) that is located at an end of the suction channel. The control valve can open to allow air to flow through the suction channel.

In some embodiments, the connector can have a connector sealing surface that is in the shape of a truncated cone. The connector sealing surface can include an elastomer.

In certain embodiments, the pump can be driven by an electric drive unit that includes an electric motor and a drive shaft that are connected to each other. The electric drive unit can be coupled with a drive shaft of the pump.

The details of one or more embodiments of the invention are set forth in the accompanying drawings and the description below. Other features and advantages of the invention will be apparent from the description and drawings, and from the claims.

DETAILED DESCRIPTION

Figure 1:
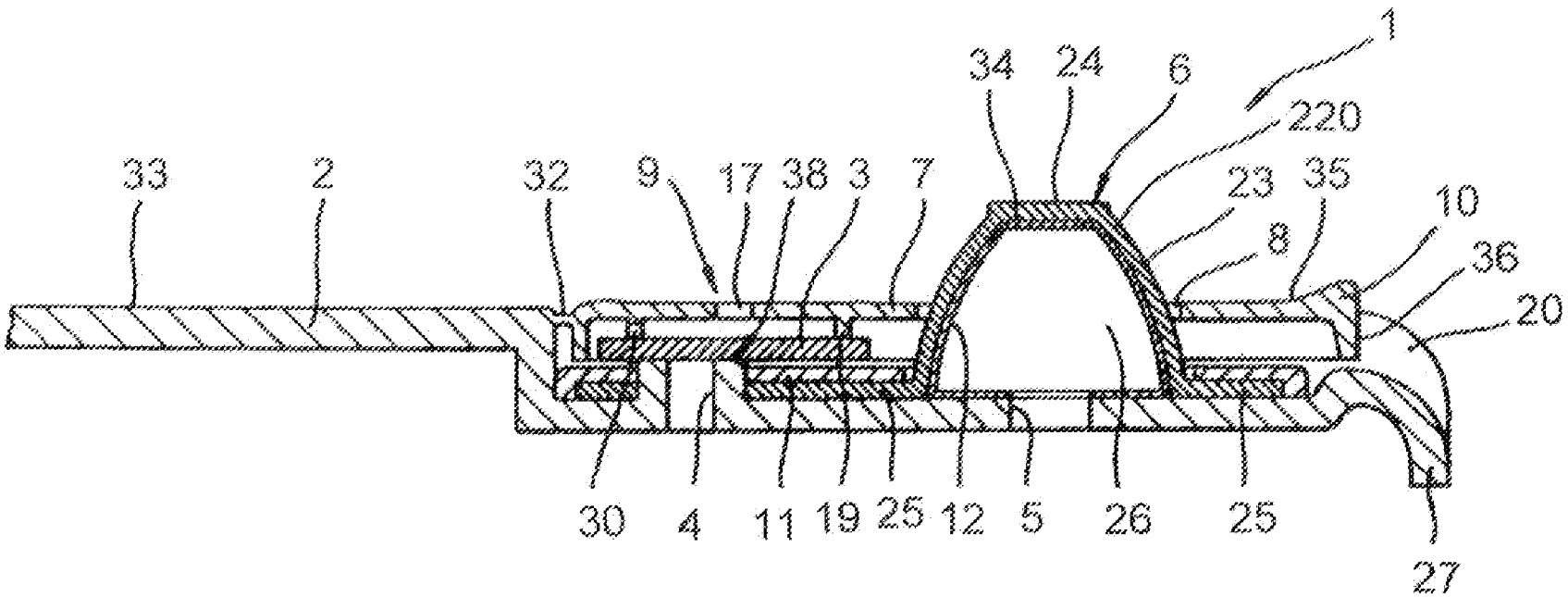
FIG. 1 is a schematic cross-sectional view of a first valve device for a food storage container when there is an insufficient vacuum inside of the container.
Figure 2:
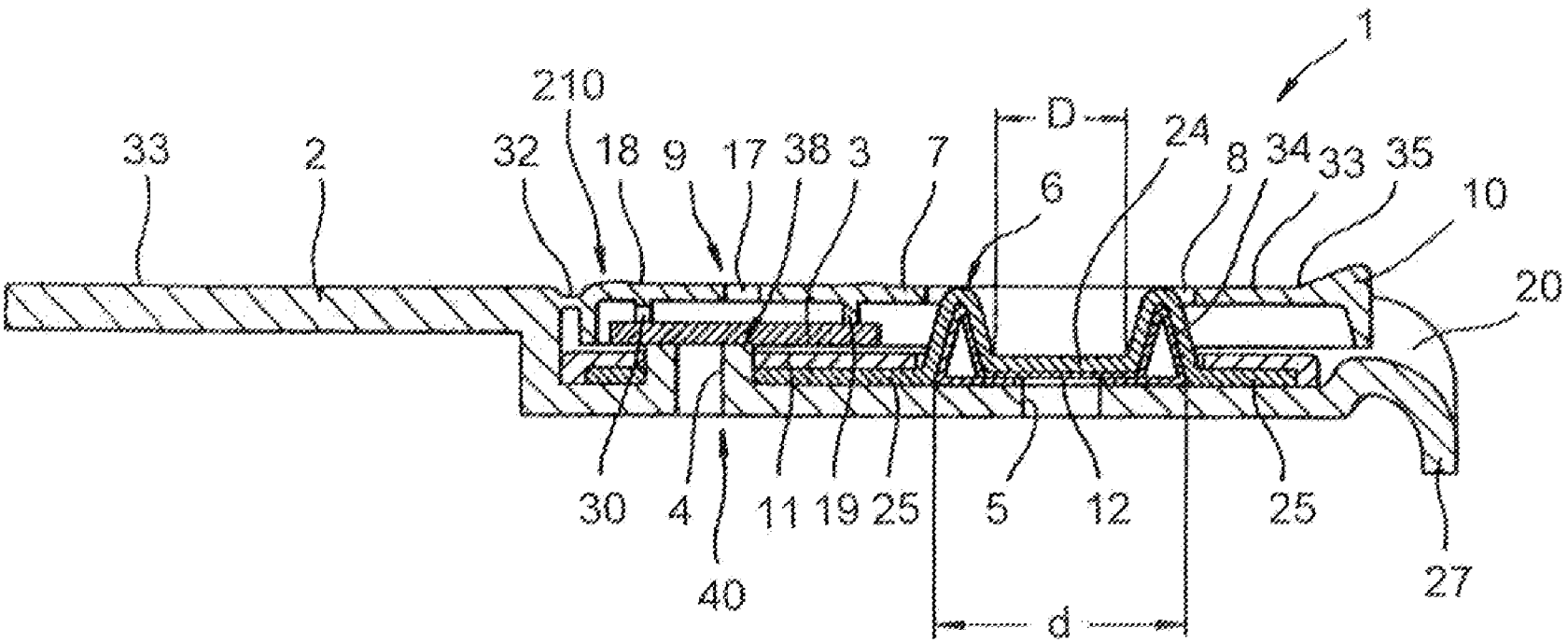
FIG. 2 is a schematic cross-sectional view of the valve device of FIG. 1, when there is a sufficient vacuum inside of the container.
Figure 3:
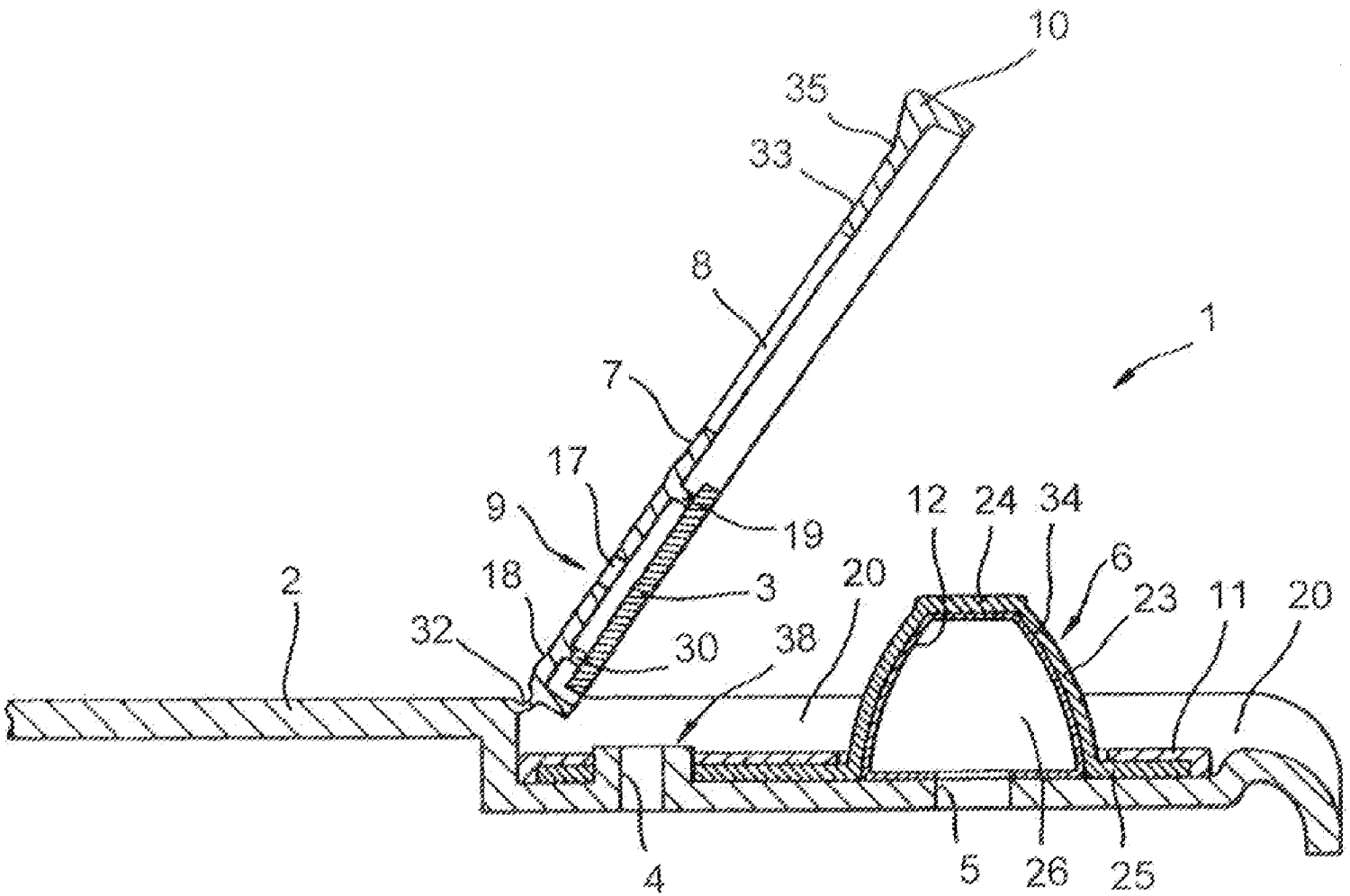
FIG. 3 is a schematic cross-sectional view of the valve device of FIG. 1, when the inside of the storage container is at atmospheric pressure.

Referring to FIGS. 1-3, a valve device 1, which is engageable with a food storage container 15, includes a pressure indicator 6 (a pressure-indicating protrusion).

Referring now to FIGS. 1-6, valve device 1 is mounted on a container lid 2. A cover 7 is integrally connected to container lid 2 by means of a hinge 32 (as shown, a film hinge). Cover 7 and container lid 2 are injection moldings made of a temperature-resistant thermoplastic material. Cover 7, which in the plan view can be in the form of an oval plate, includes a connecting device 9. Connecting device 9 allows container lid 2 to releasably engage a suction device such as a vacuum pump—e.g., connecting device 9 provides a suction port for a vacuum pump. Connecting device 9 is formed by a smooth annular surface 18 on the outer side 210 of cover 7, and by one or more evacuation holes 17 within annular surface 18. Surface 18 can have any of several configurations intended to provide a seal against a suction device pressed against the surface. A suitable connecting device is described in U.S. Patent Publication No. 2004/0040961 A1, published on Mar. 4, 2004, and entitled "Food Storage Containers", the entire contents of which are hereby incorporated by reference.

Preferably, the suction device will have a circumferential sealing lip, which acts like a suction cup, extending about its suction opening. For suction devices of this type, the suction surface of the sealing lip preferably has no structuring, thus enabling the suction power to be fully applied to evacuating the storage container. In addition, the evacuation hole or holes may have any cross-section within the smooth peripheral sealing region. The sealing surface may also extend in an undulating circle, the only provision being that the circumferential sealing lip of the suction device is then accordingly adapted in order to establish a tight connection.

In FIGS. 1-6, a sealing tab 3 (of, e.g., elastomeric plastic) is disposed on the lower side of cover 7, underneath connecting device 9.

In the valve device 1 shown in FIGS. 1-3, sealing tab 3 is fastened to cover 7 by a circular-ring-shaped bar 19, and is a separate component in the shape of a disk. Bar 19 includes an air passage 30.

In FIGS. 1-6, cover 7 is inserted in a recess 20 in container lid 2 of storage container 15. The recess is adapted to cover 7, and is essentially rectangular. A vent hole 4 is provided in container lid 2, under connecting device 9 of cover 7 and under sealing tab 3. When open, vent hole 4 provides a connection between the atmosphere and the interior 22 of storage container 15. When closed, vent hole 4 is closed air-tight by sealing tab 3. Vent hole 4 and sealing tab 3 together form a one-way valve 40 (e.g., a flapper valve), which closes in the direction of storage container 15.

Figure 4:
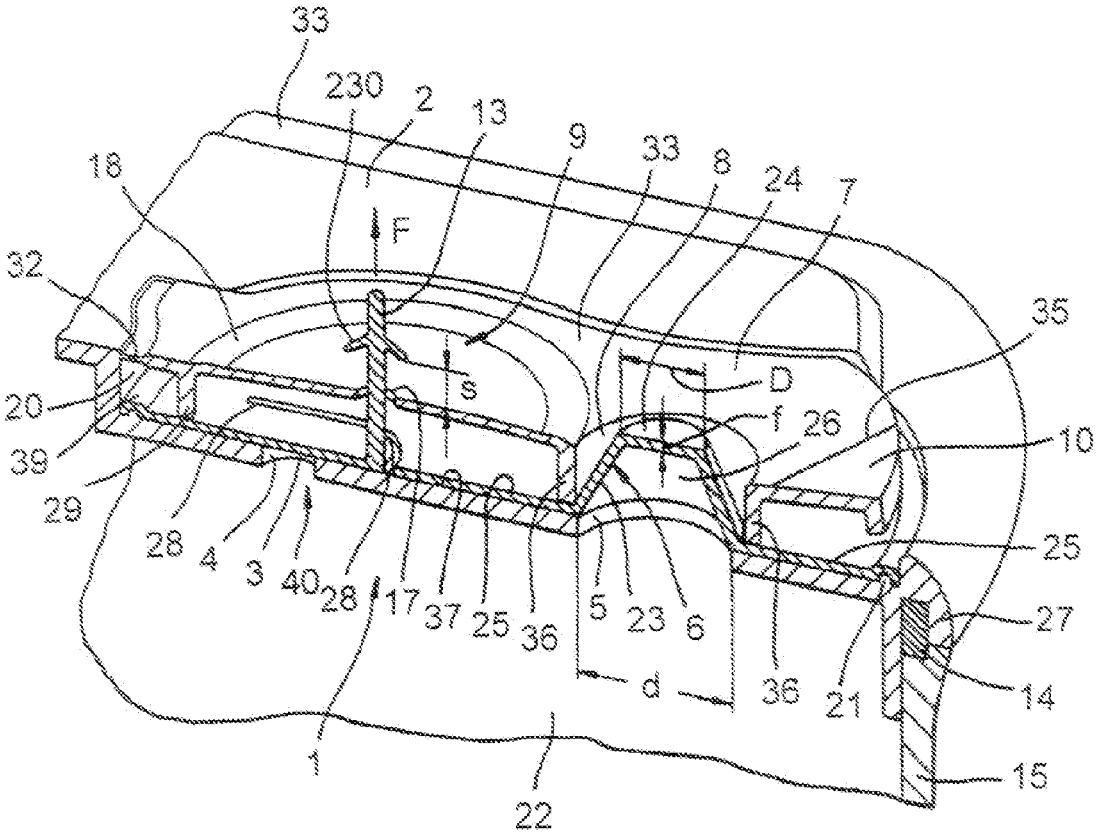
FIG. 4 is a perspective view, partially in cross-section, of a second valve device for a food storage container, when there is an insufficient vacuum inside of the container.

In FIGS. 1-6, a measurement opening 5 in container lid 2 is arranged adjacent to vent hole 4. Pressure indicator 6 includes a plastic membrane 220 which provides an air-tight covering for measurement opening 5. Pressure indicator 6 extends in an upward direction, essentially perpendicular to the plane of container lid 2. When there is an insufficient vacuum in the container, the entire pressure indicator projects upward relative to the plane of container lid 2. In other words, pressure indicator 6 displays an essentially cup-shaped, slightly outwardly domed side wall 23, which tapers in an upward direction and terminates with a horizontally extending circular top 24, as shown in FIGS. 1 and 3-5. Referring specifically to FIG. 4, top 24 has a diameter "D" which is smaller than the diameter "d" of the opening on base 25 of pressure indicator 6. As shown in FIG. 2, side wall 23 of pressure indicator 6 folds into a cavity 26 (FIG. 1) in the pressure indicator when exposed to vacuum.

Referring to FIGS. 1-6, cover 7 includes an indicator opening 8 at the position of pressure indicator 6. When the pressure in interior 22 of storage container 15 is not sufficiently below atmospheric pressure, pressure indicator 6 extends vertically out through indicator opening 8, past outer surface 33 of cover 7. Pressure indicator 6 can be made of an elastomeric plastic. Preferably, the pressure indicator is of an easily visible color (for example, the pressure indicator can be red to distinguish it from the surrounding material of the container lid, if the surrounding material is not red). In FIGS. 1-3, pressure indicator 6 is reinforced on its inner side by a layer 12 that preferably includes a resilient material, such as a spring sheet or elastomeric plastic. The surface of layer 12 is engaged with inner side 34 of pressure indicator 6.

In FIGS. 1-6, the section of cover 7 that is closest to the edge of storage container 15 has a gripping surface 10. For example, as shown in FIGS. 1-6, an end of cover 7 is beveled slightly upward starting at point 35, thereby forming gripping surface 10. Container lid 2 includes a recess 20 with a bottom 37. Cover 7 is separated from bottom 37 of recess 20 by ribs 29 and 36. Thus, gripping surface 10 of cover 7 can be comfortably gripped between the user's finger and thumb (not shown) and pulled open in an upward direction.

FIGS. 1-3 show a retaining clip 11 which presses the elastomeric plastic material of the planar base 25 of pressure indicator 6 against container lid 2. Retaining clip 11 is held in place by walls of the container lid recess (20). In FIGS. 1-3, cup-shaped pressure indicator 6 is integrally connected to base 25. Thus, when pressure indicator 6 is clamped by retaining clip 11, the pressure indicator effectively is sealed to container lid 2.

Figure 5:
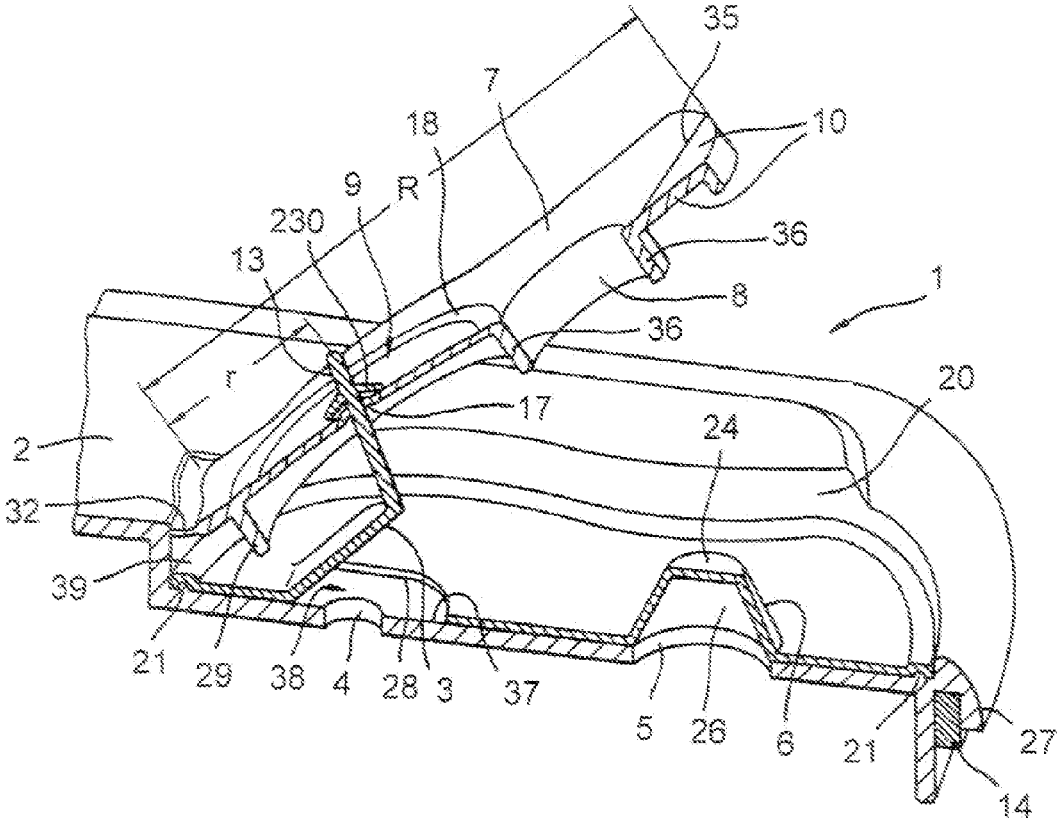
FIG. 5 is a perspective view, partially in cross-section, of the valve device of FIG. 4, when a vent has been opened in the storage container.
Figure 6:
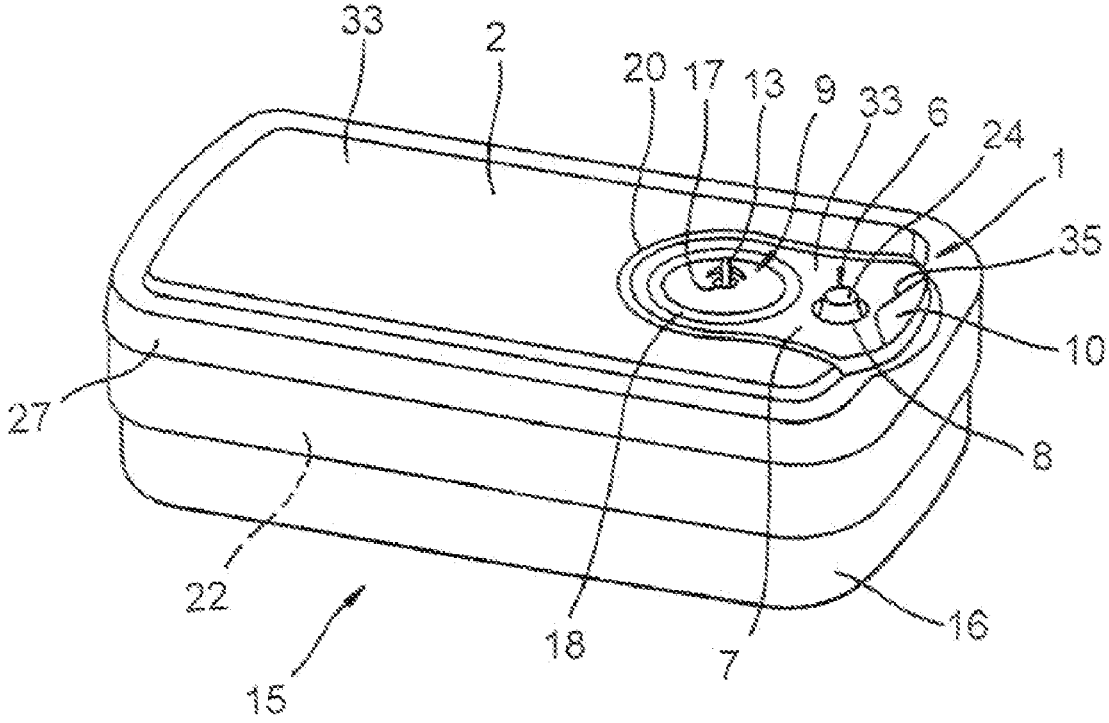
FIG. 6 is a perspective view of a food storage container including the valve device of FIG. 4.

Referring to FIGS. 4-6, a second example of a valve device 1 also includes a pressure indicator 6 for a food storage container 15. Cover 7 is again integrally connected to container lid 2 by means of a film hinge 32. Sealing tab 3 is arranged underneath connecting device 9 of cover 7. Sealing tab 3 is connected to cover 7 by a driving element 13. Sealing tab 3, driving element 13, base 25, and pressure indicator 6 all are made of a single elastomeric plastic part which is fastened as an insert to a bead 21 in recess 20 of container lid 2. The plastic material used for pressure indicator 6 has spring-like properties. Thus, the pressure indicator can snap into a position that indicates whether there is a sufficient vacuum inside the container.

When vacuum is applied to the valve device 1 of FIGS. 4-6, cover 7 is pressed by the vacuum pump against the base of sealing tab 3 and pressure indicator 6, thus producing a tight valve device and simultaneously rendering the pressure indicator well visible.

When vacuum is applied to the valve device 1 of FIGS. 1-3, cover 7 presses against sealing tab 3 to hold the sealing tab securely against container lid 2. Here, too, pressure indicator 6 is well visible.

There are some differences between the valve device 1 of FIGS. 1-3 and the valve device 1 of FIGS. 4-6. In FIGS. 1-3, sealing tab 3 forms a separate sealing part relative to pressure indicator 6. In the valve device of FIGS. 4-6, however, these parts are formed by a single elastomeric component—sealing tab 3 is partially cut out of base 25, thereby forming a gap 28. Furthermore, in FIGS. 4-5, a circumferential seal 14 is disposed around the edge of container lid 2. The seal enables the lid to be closed air-tight against the storage container 15. In FIGS. 1-3, on the other hand, lid 2 itself forms a tight closure with storage container 15 (i.e., there is no circumferential seal 14). When valve device 1 is closed, circumferential rib 29 presses base 25 against bottom 37 of recess 20, thus effecting a seal. Another difference between the valve device 1 of FIGS. 1-3 and the valve device 1 of FIGS. 4-6 is that the valve device shown in FIGS. 4-6 includes driving element 13, while the valve device shown in FIGS. 1-3 does not.

In FIGS. 1 and 3-6, the pressure in interior 22 of storage container 15 is equal to ambient pressure. Because of its spring bias, pressure indicator 6 thus projects out through indicator opening 8 and beyond cover 7.

In FIG. 2, there is sufficient vacuum in interior 22 of storage container 15. Pressure indicator 6 is thus drawn into its cavity 26, toward container interior 22. The pressure indicator is in a folded or snapped-in condition. In this state, pressure indicator 6 either does not project at all beyond the outer contour of cover 7, or else projects beyond the outer contour by a negligible amount. Pressure indicator 6 folds like a rolling membrane. The ratio of diameter "D" to diameter "d" is selected based on the wall thickness "f" and the elastic material of pressure indicator 6, so that the pressure indicator will abruptly fold together when there is a sufficient vacuum in the interior of the container (as shown in FIG. 2). If the vacuum in container interior 22 decreases, then at the point of insufficient vacuum, pressure indicator 6 will make an abrupt outward movement, snapping back into the position shown in FIGS. 1 and 3-6. Thus, the user has a clear indication of whether there is a sufficient vacuum in the container.

A user can first inform himself about the pressure status in container interior 22 by checking the position of pressure indicator 6 when container lid 2 is closed. If the bottom of pressure indicator 6 projects out through indicator opening 8, then the pressure in container interior 22 is insufficient for guaranteeing the storage of food under vacuum conditions (as is the case in FIGS. 1, 4, and 6).

In FIGS. 1, 3, and 6, storage container 15 is evacuated. To evacuate the container, a suction port with a circumferential sealing lip of a vacuum pump (not shown) is placed on connecting device 9 of valve device 1. Then, the vacuum pump is put into operation, causing vent hole 4 of valve device 1 to automatically open. Vent hole 4 opens because the suction effect causes sealing tab 3 to lift off from the vent hole, and the air contained in storage container 15 is drawn off by the vacuum pump. In FIG. 1, the air is drawn through vent hole 4, past the side of sealing seat 38 of sealing tab 3, around the outside of sealing tab 3, through air passage 30, and through connecting device 9 to the vacuum pump. As shown in FIG. 2, when a sufficient vacuum is attained in interior 22 of storage container 15, pressure indicator 6 suddenly snaps inward, thereby informing the user that he can end the evacuation operation. After the vacuum pump is disengaged from connecting device 9, sealing tab 3 is pressed against the edge of vent hole 4, automatically closing it air-tight. This operation also occurs with each return stroke of the vacuum pump, in order to enable a vacuum to be built up in interior 22. The vacuum in interior 22 keeps enclosed food fresh for a long time because lack of oxygen prevents the food from being oxidized.

To remove food from storage container 15, the user grips cover 7 with two fingers under gripping surface 10 and, with little force, swivels cover 7 in a counterclockwise direction (as shown in FIG. 5). Referring to FIG. 3, sealing tab 3 is thus lifted by cover 7 in an upward direction, off sealing seat 38, and vent hole 4 is cleared. In the valve device 1 shown in FIG. 5, the upper side of cover 7 first comes up against the lower side of a rim 230 (having, e.g., a generally conical shape) formed on driving element 13. The upper side of cover 7 then pulls driving element 13 and sealing tab 3 upward, until sealing tab 3 lifts off from sealing seat 38 and swivels upward in a counterclockwise direction. Referring to FIGS. 3 and 5, air can now flow into container interior 22 via vent hole 4.

Container lid 2 can now be removed from storage container 15 without any notable effort. In FIGS. 4-5, sealing tab 3, which is partially separated from the rest of planar base 25 by gap 28, and which is connected to base 25 only in area 39, repeatedly falls back onto vent hole 4 as a one-way valve acting under the force of gravity. Thus, it is relatively easy to produce a vacuum in the container. It also is conceivable, however, for cover 7 to be designed to snap into place by means of clip connectors on container lid 2, thereby enabling sealing tab 3 to close vent hole 4. Referring to FIG. 3, sealing tab 3 also is lifted when cover 7 is swiveled around film hinge 32 because the sealing tab is fastened with clearance to cover 7, in order to perform the function of a one-way valve.

Referring to FIG. 6, a thermoplastic food storage container 15 includes the valve device 1 of FIG. 4. Storage container 15 has a container body 16 in the shape of a right-parallelepiped and, when viewed from the top, has an essentially rectangular container lid 2 with a circumferential rim 27. Valve device 1 is arranged in a recess 20 on one of the narrow sides of container lid 2. Gripping surface 10 of cover 7 terminates approximately with outer surface 33 of container lid 2. When there is insufficient vacuum inside of the container, only pressure indicator 6 projects vertically out of indicator opening 8 of cover 7. Adjacent to pressure indicator 6 are connecting device 9 (which can be, for example, a circular connecting device), with smooth annular surface 18, and evacuation hole 17, from which driving element 13 projects with its rim 230. Rim 230 improves the driving effect of driving element 13 when cover 7 is swiveled upward. Through the leverage produced by distances "R" and "r" (shown in FIG. 5), relatively little manual force "F" (shown in FIG. 4) needs to be applied to grip surface 10 and lift sealing tab 3 from sealing seat 38, even when there is still a vacuum in interior 22 of the container. As distance "r" becomes smaller and distance "R" becomes larger, it becomes easier to open valve device 1.

Figure 7:
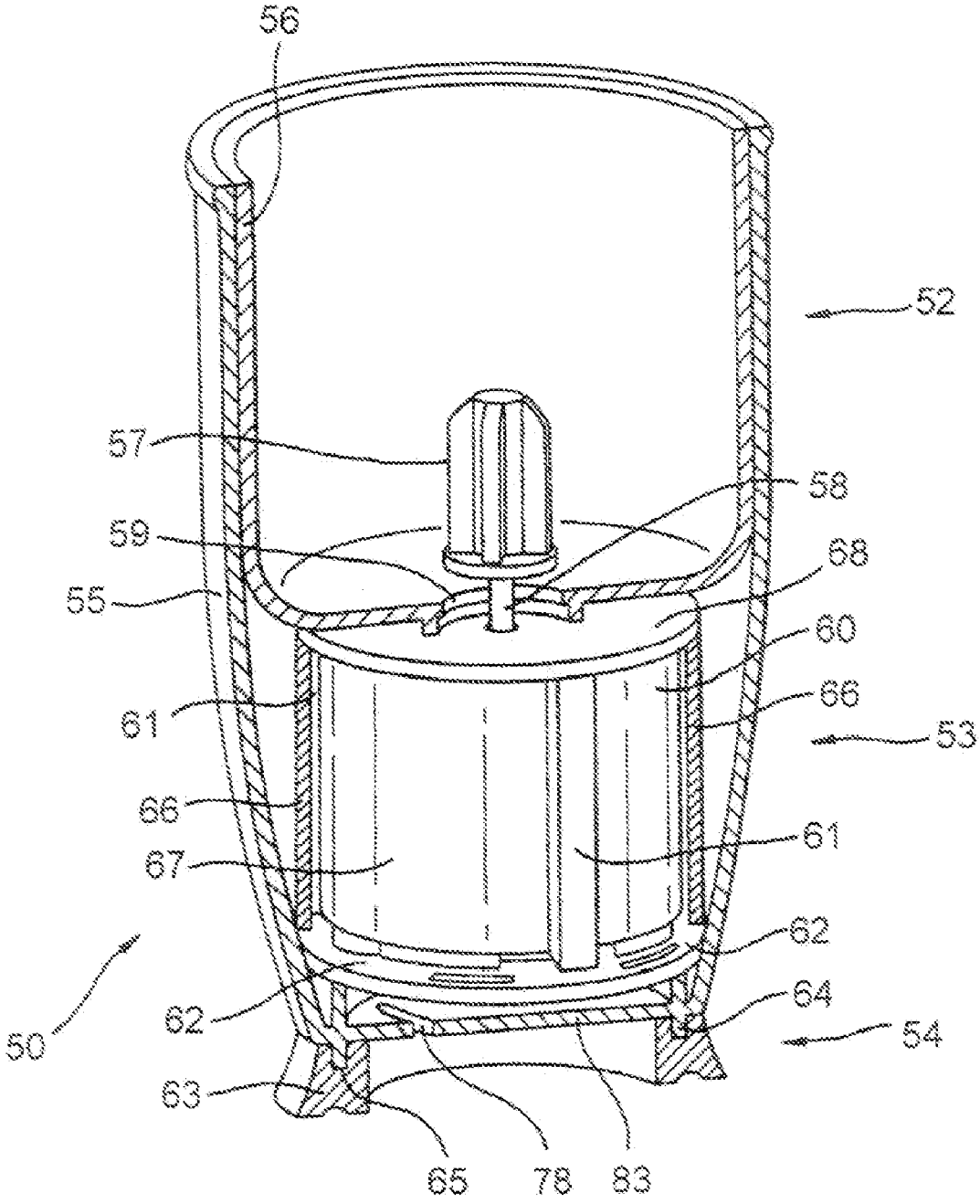
FIG. 7 is a schematic cross-sectional view of a device for evacuating a food storage container.
Figure 8:
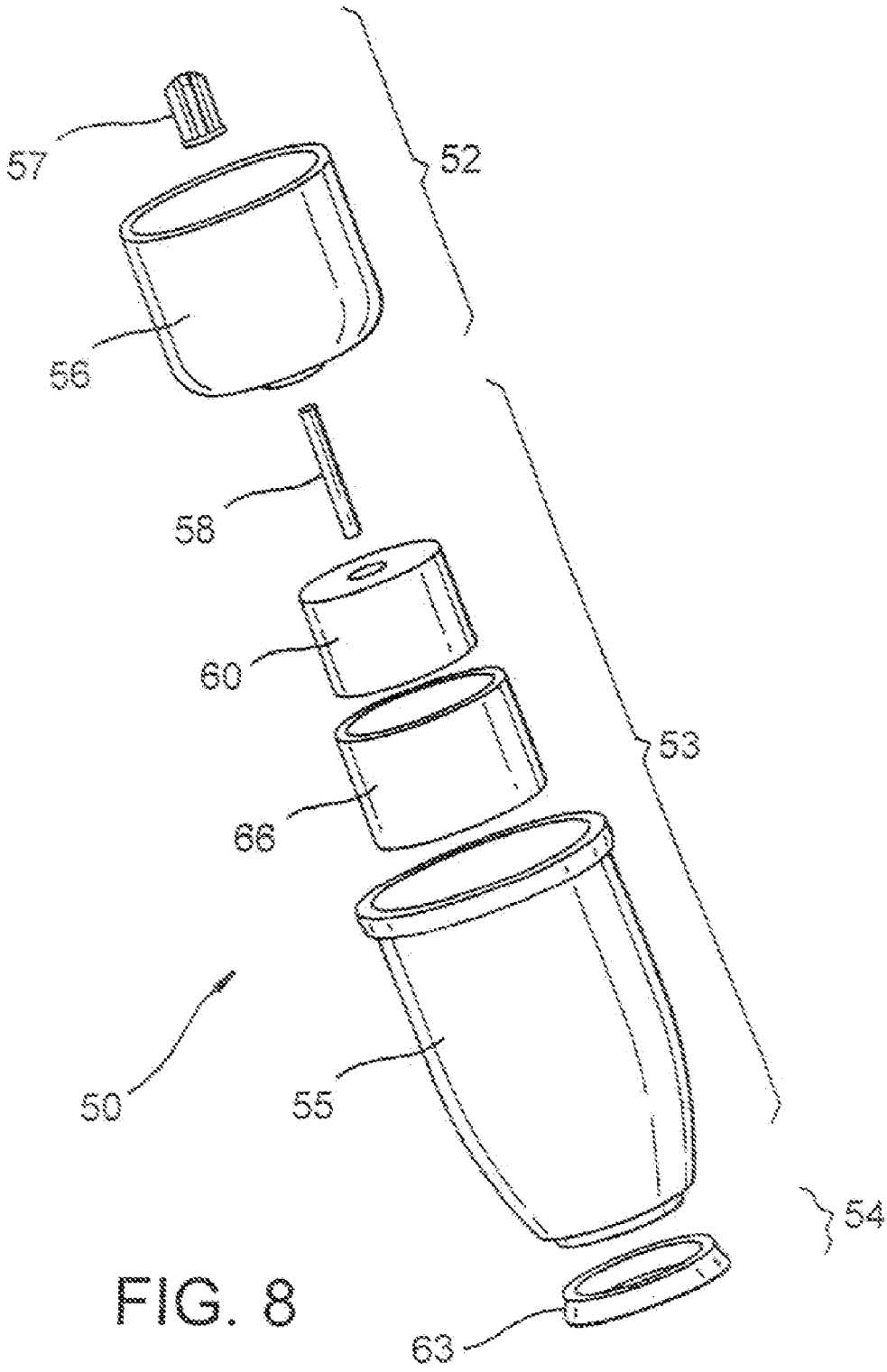
FIG. 8 is an exploded perspective view of the device of FIG. 7.

Referring now to FIGS. 7 and 8, an attachment 50 includes an attachment housing 55 with a coupling section 52 and a pump section 53. Attachment 50 also has a suction section 54. The coupling section is formed by a cup-shaped plug-in shank 56, within which is disposed a coupling gear 57. In the base area of the plug-in shank is a base opening 59, through which a shaft 58 passes. The shaft is connected to coupling gear 57. Disposed within pump section 53 is a vacuum pump 67.

Figure 9:
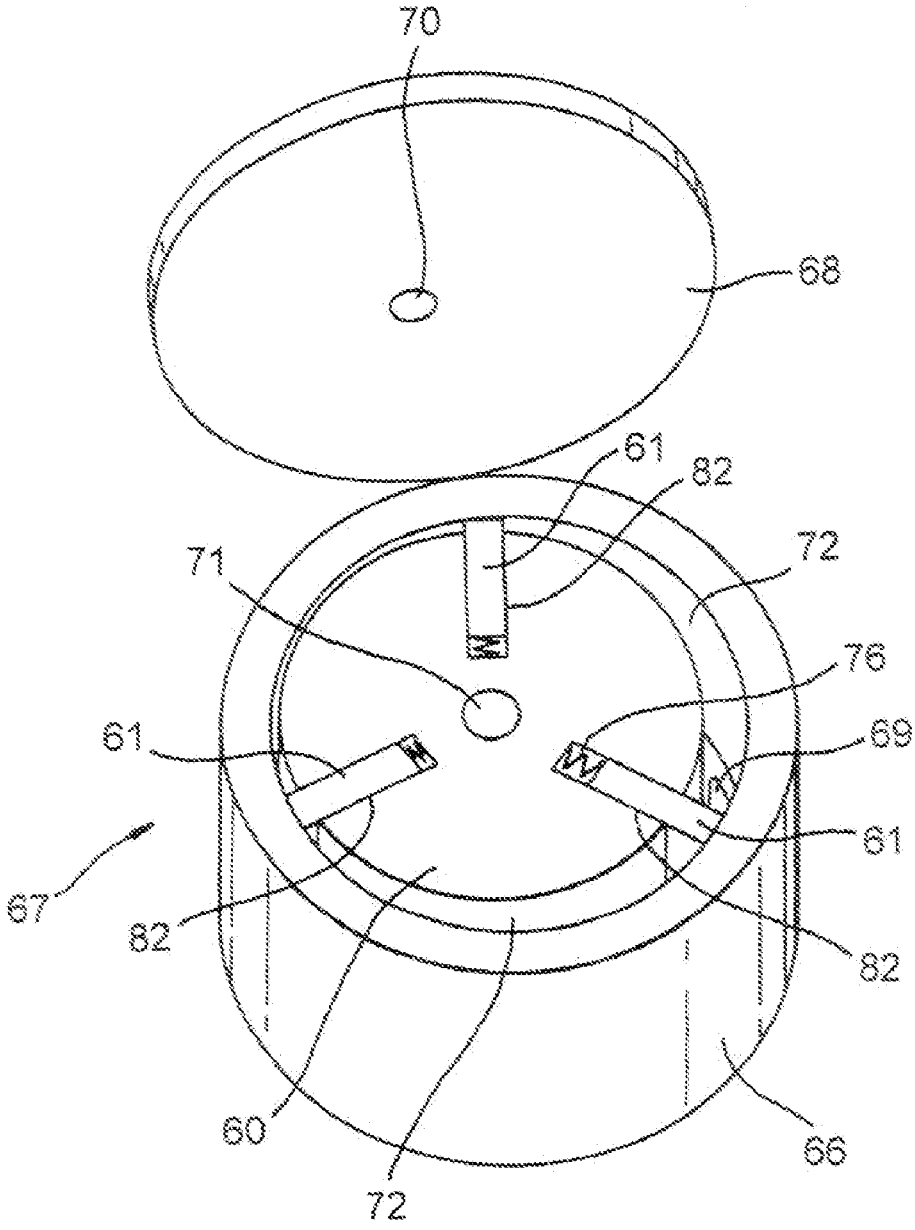
FIG. 9 is a perspective view of a portion of the device of FIG. 7.

As shown in FIGS. 7 and 9, vacuum pump 67 is a vane-type pump. Referring now to FIGS. 7-9, the housing of the vane-type pump is formed by a ring 66 (e.g., a graphite ring), which is covered at its upper and lower ends by a circular upper end disk 68 and a lower end disk 62, respectively. A cylindrical rotor 60 is eccentrically mounted for rotation in the pump housing. Rotor 60 has an arrangement of uniformly distributed radial slots 82, within which radially displaceable vanes 61. Vanes 61 are pressed against graphite cylinder 66 by centrifugal force, supported by the force of springs 76. The result is the formation of fluid-delivery cells 72, which together form a crescent-shaped configuration.

As FIG. 7 shows, rotor 60 is connected to shaft 58. At one of its ends, shaft 58 passes through upper end disk 68. The end of the shaft which projects out of the upper end disk has a coupling gear 57, which is constructed as a spur-toothed gear. Furthermore, in coupling section 52, an annular sheath continues along the wall of housing 55. This shaft-side housing end of attachment 50, which is constructed as a plug-in shank 56, is adapted to be connected to the tool-side end of an immersion blender.

Referring now to FIGS. 7 and 8, around the other circumference of the other end of housing 55 is a circumferential sealing lip 63 made of an elastic rubber material. The sealing lip has a groove 65, which allows it to connect to a bar 64 on housing 55. Sealing lip 63 is constructed to act as a kind of suction cup when in operation. Housing 55 includes a cover 83, which has suction slots 78, fitted to the end of the housing that engages the sealing lip. The suction slots lie within the section of cover 83 that is surrounded by annular sealing lip 63.

Referring now to FIG. 9, vacuum pump 67 includes upper end disk 68 (shown in the opened position) which, like graphite cylinder 66 and lower end disk 62, is made of graphite. A bore 70 is eccentrically located in circular upper end disk 68, and acts as the shaft bearing of rotor shaft 58 (not shown here). Bore 70 is constructed as a self-lubricating plain bearing. Rotor 60, carried by shaft 58, is arranged within graphite cylinder 66 which, together with upper end disk 68 and lower end disk 62, forms the pump housing of vacuum pump 67.

Carbon-fiber rotor 60 is arranged eccentrically relative to the center of graphite cylinder 66. The rotor has three slots 82 arranged at an angular offset of 120° to each other, in which vanes 61 are guided, such as to be longitudinally displaceable in the radial direction. The vanes are fabricated essentially as rectangular graphite plates.

Rotor 60 includes a shaft bore 71. At the ends of the vanes that face shaft bore 71, the vanes are acted upon by the pressure of compression springs 76. Suction opening 69 is arranged on lower end disk 62, and provides a way for air to be drawn out of a storage container. Fluid-delivery cells 72 are formed by rotor 60, upper end disk 68, lower end disk 62, graphite cylinder 66, and vanes 61.

Figure 10:
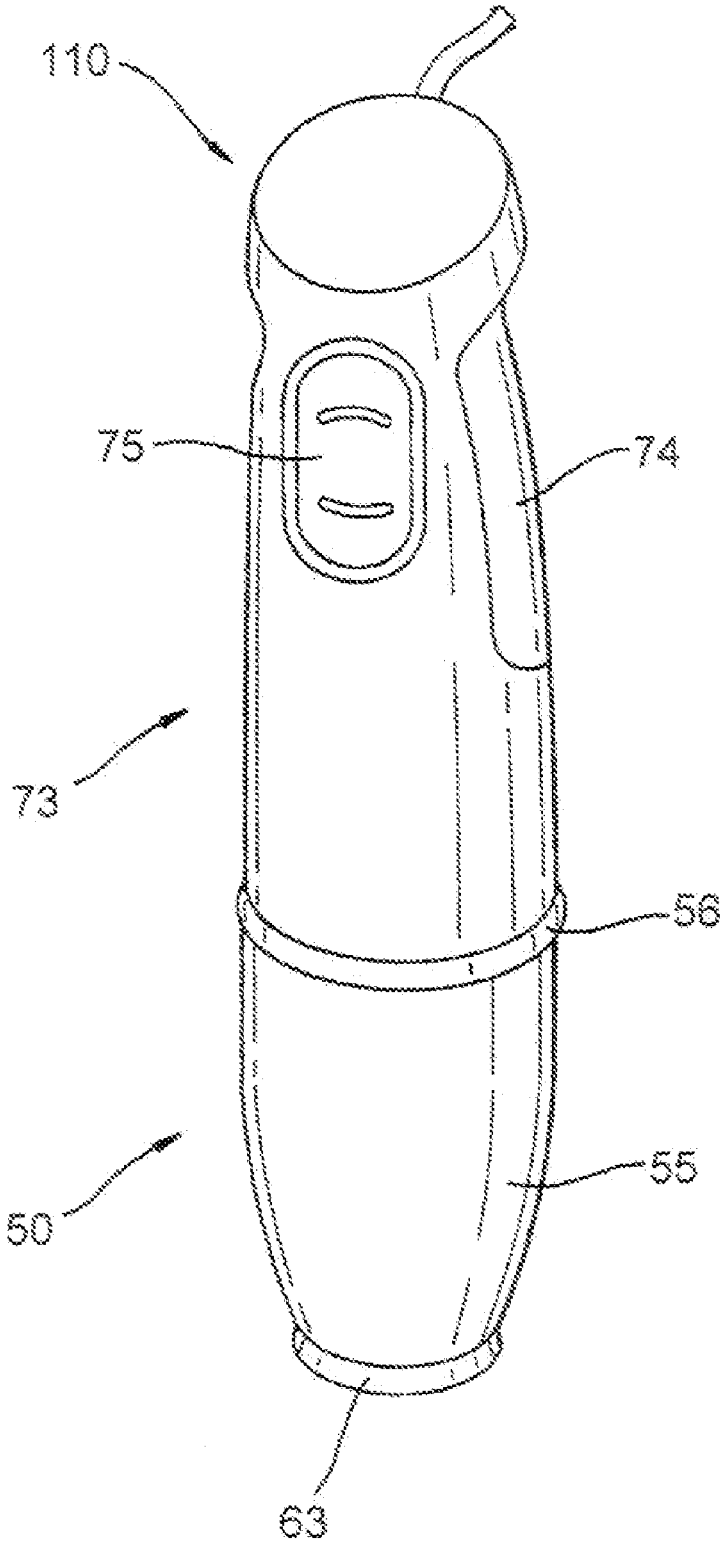
FIG. 10 is a perspective view of an immersion blender with an attachment.

When vacuum pump 67 is in operation, the rotor turns with the shaft speed of the immersion blender to which attachment 50 is attached (such as immersion blender 73, shown in FIG. 10). As the result of centrifugal force and spring force, vanes 61 slide along the inner wall of the graphite ring, hence guaranteeing that pressure compensation does not occur between the various fluid-delivery cells.

In FIG. 10, attachment 50 is mounted on the output end of immersion blender 73, forming a vacuum pump unit 110. The essentially elongated cylindrical equipment combination has at its upper end a grip 74 which can be gripped all-round by a user's hand. On the front side of the immersion blender, in its upper region, is an actuating switch 75, which is easy to operate with the gripping hand.

In the arrangement of FIG. 10, the upper region of attachment housing 55, which is constructed as plug-in shank 56, couples with the slightly conical output end of immersion blender 73. As this occurs, the shaft connection for driving the vacuum pump is simultaneously established.

During operation, attachment 50 is connected to the output end of immersion blender 73. The attachment is held by the annular sheath at the output end of the immersion blender, such that it cannot tilt or twist. The output shaft of the immersion blender is in positive engagement with coupling gear 57 of vacuum pump 67. The suction side of attachment 50 sits on a valve device on a food storage container, such as the valve devices 1 and food storage container 15 described above with reference to FIGS. 1-6 (see also FIG. 12). Circumferential sealing lip 63 (made of, e.g., elastomeric plastic) is arranged on the lower end of attachment 50, and forms a tight suction connection with, e.g., smooth annular surface 18 of cover 7 of valve device 1. While the storage container is being evacuated, rotor 60 of attachment 50 is set in rotation by the drive shaft of immersion blender 73.

Figure 11:
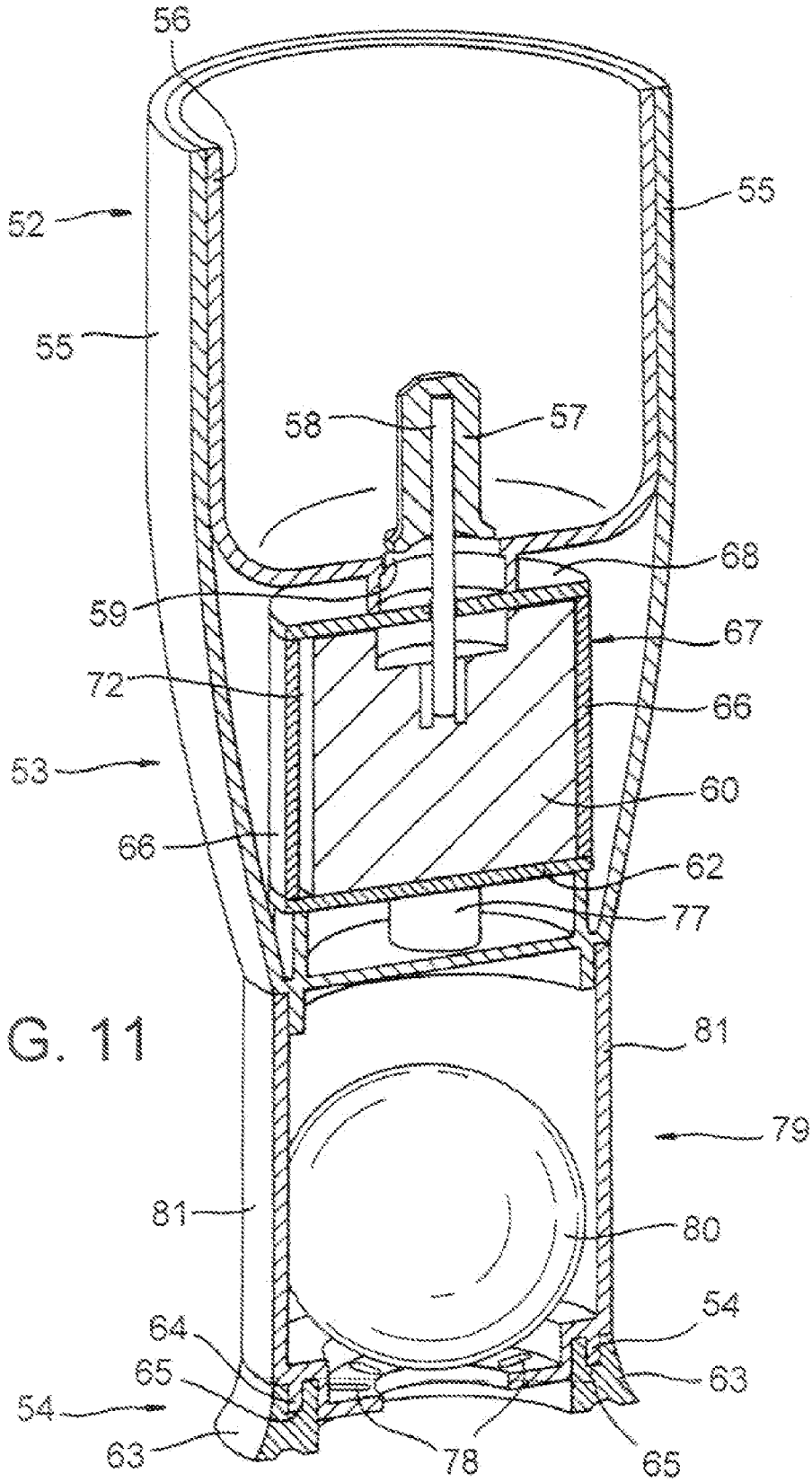
FIG. 11 is a schematic cross-sectional view of another device for evacuating a food storage container.

Referring to FIG. 11, a second example of attachment 50 further includes a float section 79, which prevents liquid from entering vacuum pump 67. The configurations of coupling section 52 and pump section 53 are essentially the same as they are in the attachment described in FIGS. 7-10.

In the attachment 50 shown in FIG. 11, float section 79 adjoins pump section 53. The float section is essentially formed by a cylindrical float housing 81 made of thermoplastic material. At its lower end, the float housing includes bar 64, which engages groove 65 of sealing lip 63, thereby forming suction port 54.

A spherical float 80 is provided in float housing 81. The float is hollow so that it easily floats on inflowing liquid. When the level of liquid in float housing 80 reaches a critical value, the lower opening of a suction pipe 77 is closed by the float. Liquid cannot then enter into vacuum pump 67. Additional suction slots 78 at the lower end of float housing 81 help to ensure that the air existing in a food storage container is evacuated.

Figure 12:
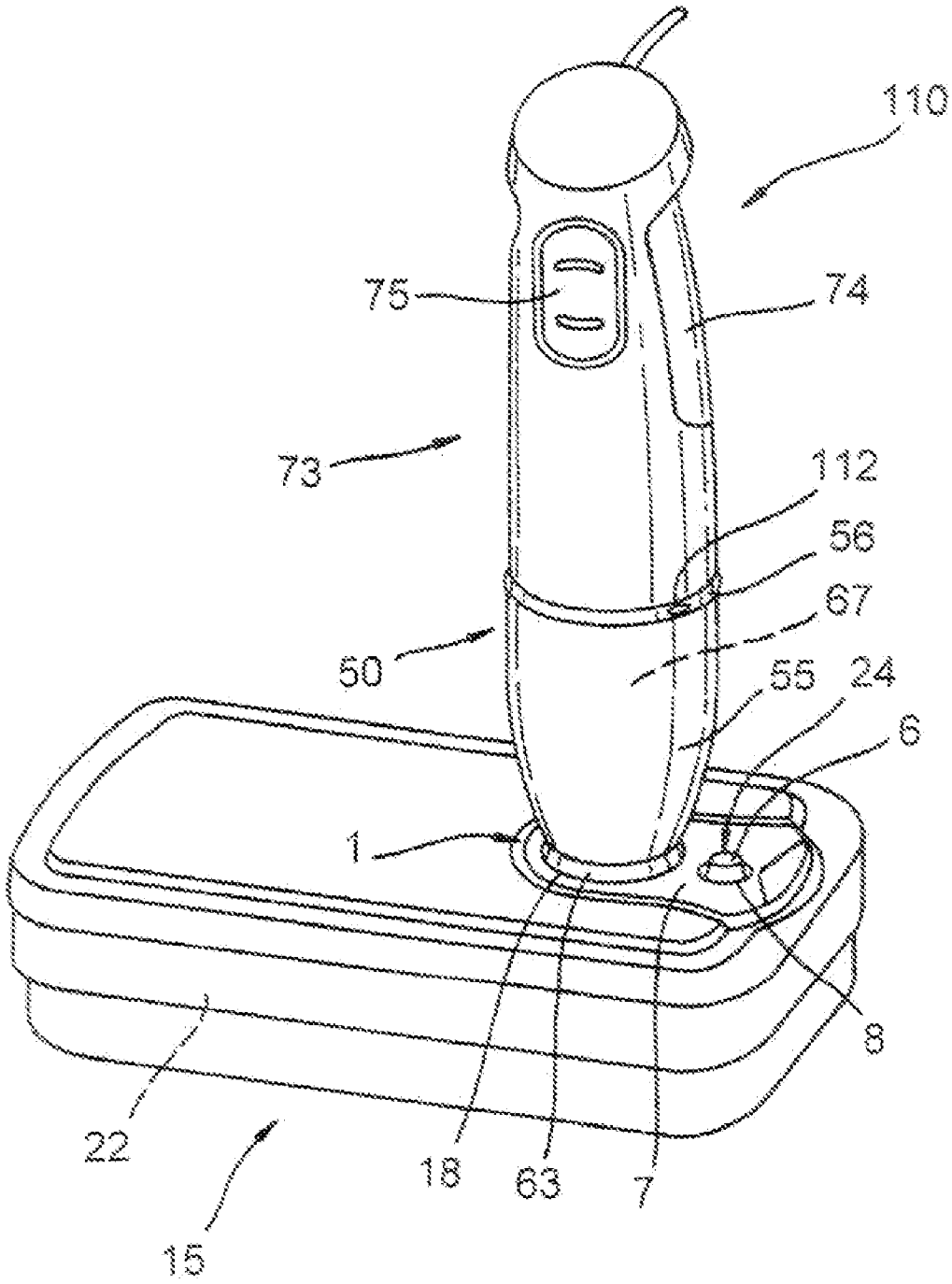
FIG. 12 is a perspective view of the immersion blender and attachment shown in FIG. 10, connected to the valve device of FIGS. 1-3.

Referring now to FIG. 12, immersion blender 73 is coupled with attachment 50, which has been flanged. The combination of the immersion blender with the attachment forms vacuum pump unit 110. To apply a vacuum to food storage container 15, vacuum pump unit 110 is manually pressed against annular surface 18 of cover 7 of valve device 1, thereby establishing a pressure-tight connection between container interior 22 and vacuum pump 67. In a pressure-free state, before vacuum pump 67 is activated, pressure indicator 6 has a convex configuration and projects outward from indicator opening 8 of cover 7.

After opening valve device 1, the air from storage container 15 is delivered outward to the atmosphere via suction slot 78, base opening 59, and a slot 112 arranged at plug-in shank 56. Once the required vacuum has been obtained in container interior 22, circular top 24 and domed side wall 23 of pressure indicator 6 move toward container interior 22. At this point, the pressure indicator is hardly visible from the outside, since it has withdrawn into indicator opening 8. A user now knows that an adequate vacuum has been applied to the storage container. Actuating switch 75 can, therefore, be manually switched off, thus bringing vacuum pump unit 110 to a standstill. The vacuum pump unit can be lifted off container lid 2 manually. When this occurs, valve device 1 shuts and the storage container is now closed in a pressure-tight manner.

If a user later wishes to open storage container 15, then the storage container must first be evacuated by opening valve device 1. To do so, the user can press downward against gripping surface 10 of cover 7, such that cover 7 is tilted upward. Thereby, the valve device gets into its open position, and air from the atmosphere can enter the storage container via the valve device. At this point, the container lid can be lifted from the container body with little effort.

FIGS. 13-20 show another embodiment of a food storage container, as well as another embodiment of a vacuum pump.

Figure 13:
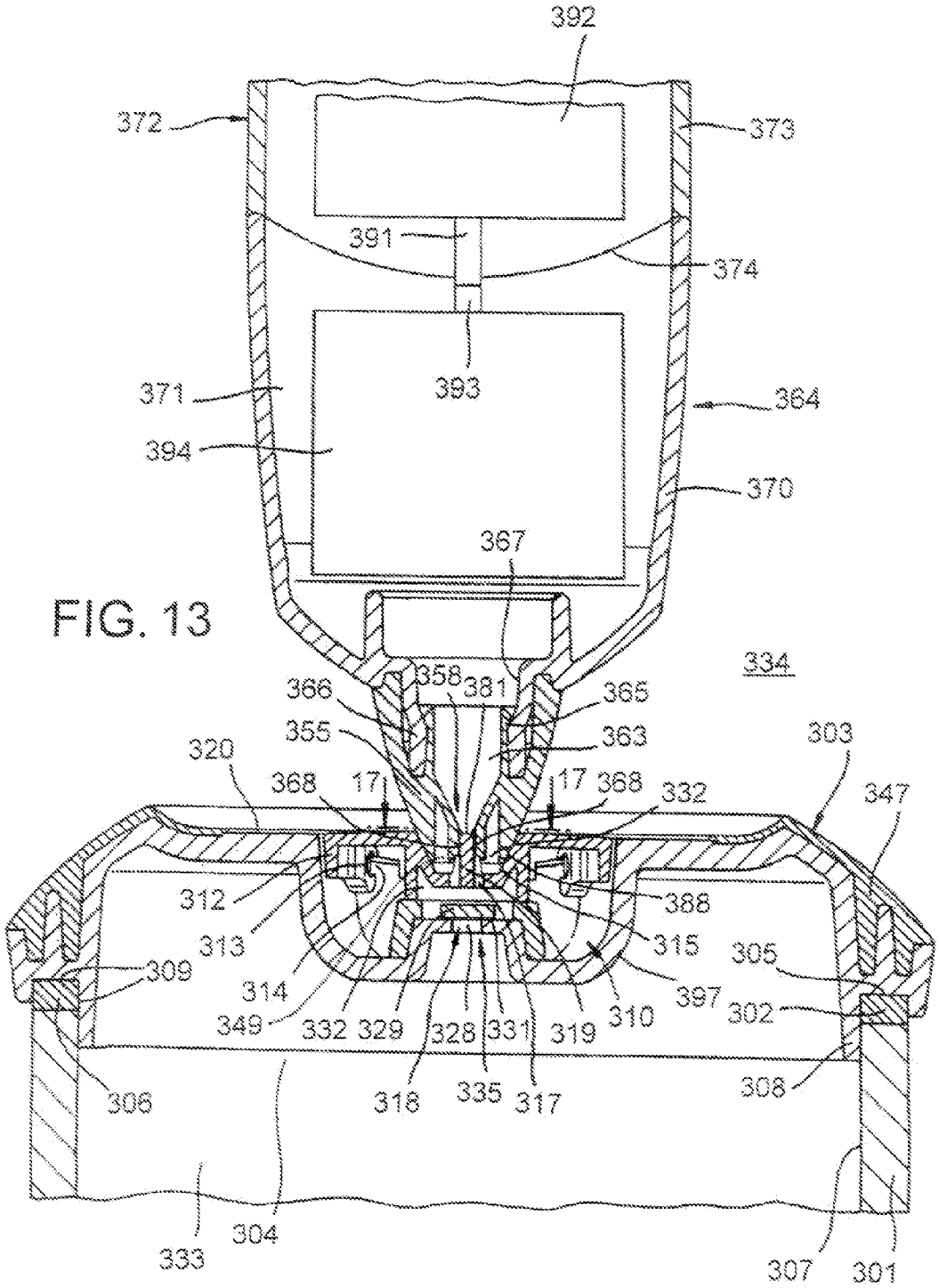
FIG. 13 is a cross-sectional view of an embodiment of a food storage container that is coupled to an embodiment of a device for evacuating a food storage container.

Referring to FIG. 13, a system 300 for evacuating a container closable by a cover includes a pot-shaped container 301 that has an essentially oval or circular cross-sectional shape and structure (although other cross-sectional shapes and structures are possible). Container 301 includes a lid/cover 303 that contacts an edge 302 of the container to close an opening 304 in the container. A sealing ring 306, which is located between edge 302 of container 301 and an edge 305 of lid 303, seals lid 303 such that lid 303 covers opening 304. For improved centering, lid 303 has a centering edge 308, which is centered on inner container wall 307.

Figure 18:
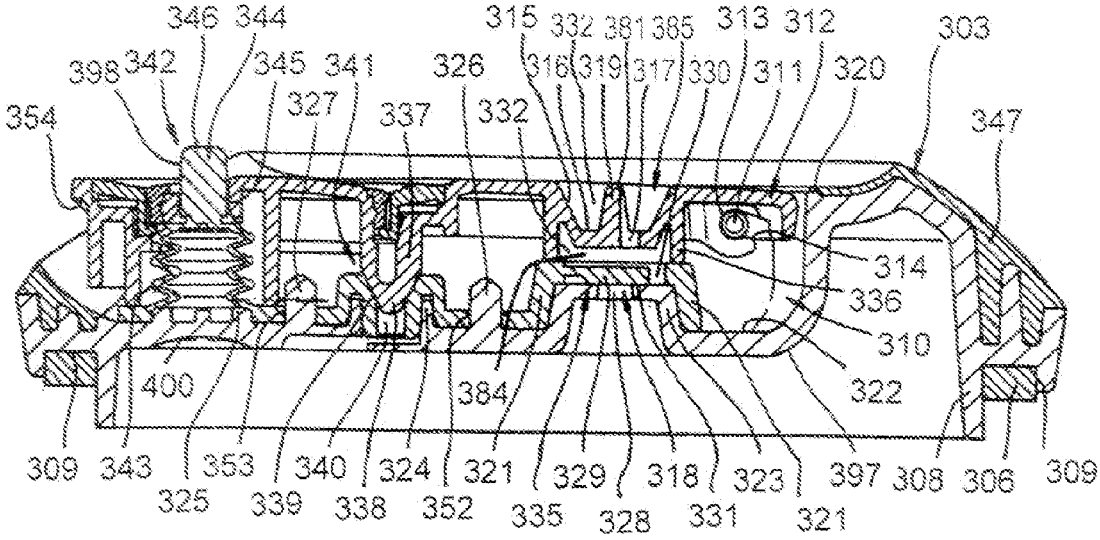
FIG. 18 is a cross-sectional side view of the container of FIG. 13.
Figure 20:
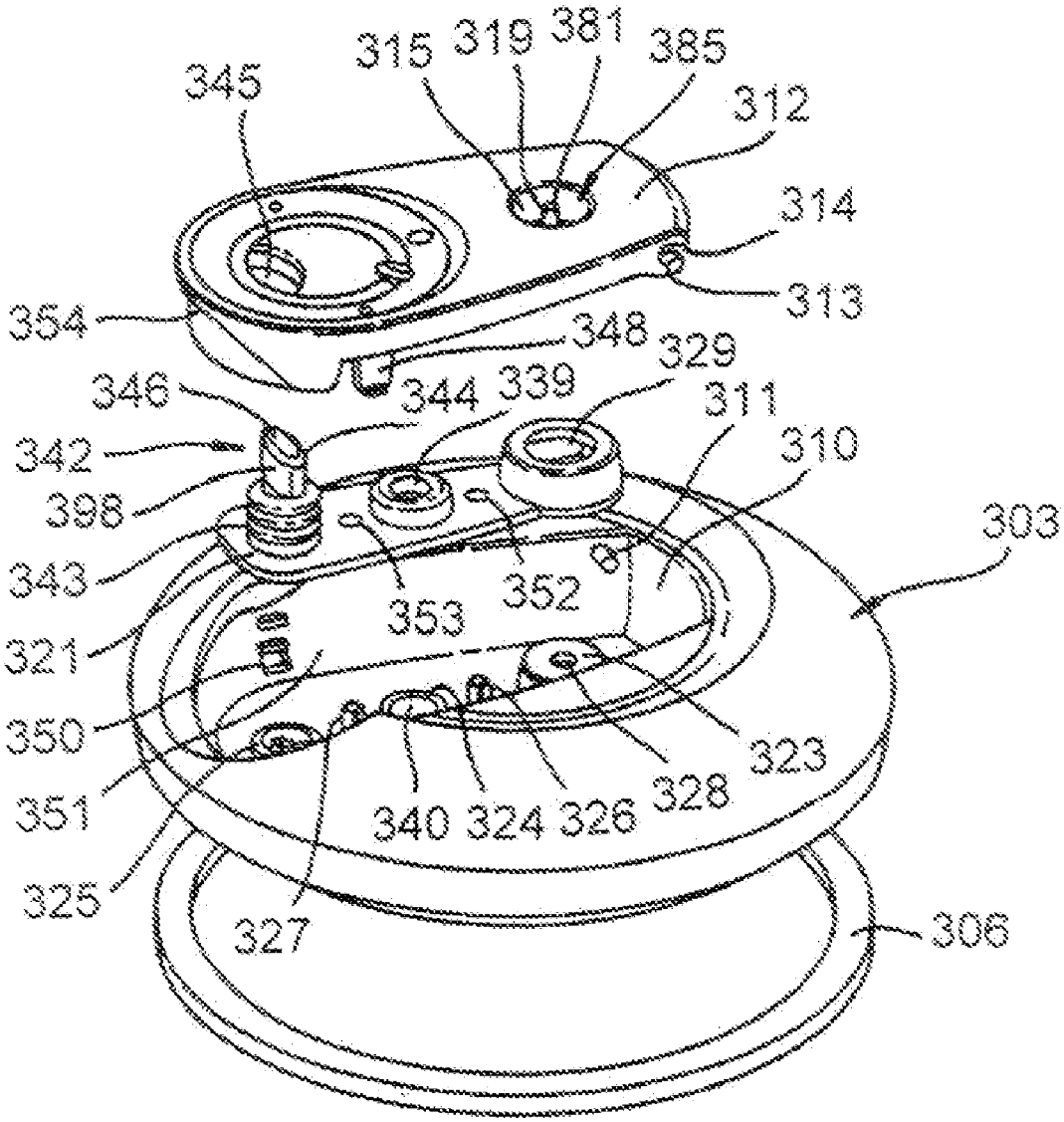
FIG. 20 is an exploded view of the container of FIG. 13.

Referring to both FIGS. 13 and 18, sealing ring 306 is inserted under prestress into a U-shaped ring groove 309, so that sealing ring 306 does not fall from lid 303. Referring now also to FIG. 20, lid 303 has an oval recess 310 running across its center. Two formed bearing journals 311, on which a valve cover 312 is positioned in an upwardly tiltable manner, are formed in recess 310, at the side walls of recess 310, diametrically opposed at the one corner. For this purpose, bearing bores 313, which are provided with slits 314 on the one side for disassembly, are formed in valve cover 312.

Valve cover 312 has a cover sealing surface 315, which tapers conically in a downward direction (forming a conical recess). Cover sealing surface 315 includes a passage 317 that is laterally formed in the bottom surface 316 of cover sealing surface 315. Passage 317 forms the outlet of a flow channel 318 (i.e., a vent opening) of lid 303. A protrusion 319 (e.g., in the form of a pin or journal), which runs approximately to surface 320 of lid 303, extends concentrically to frustoconical cover sealing surface 315 from bottom surface 316.

Formed on the underside of valve cover 312, and concentrically disposed relative to cover sealing surface 315, is a collar 336, which presses a structured, planar, band-shaped sealing sleeve 321 against bottom 322 of oval recess 310 of lid 303. Bottom 322 is also structured like sealing sleeve 321, and has three ring-shaped elevations 323, 324, and 325, as well as two upwardly protruding pilot pins 326 and 327. Pilot pins 326 and 327 center sealing sleeve 321 and penetrate bores 352 and 353, which are formed in sealing sleeve 321. Elevation 323 includes a passage 328 in its center. Passage 328 is closed from above by a sealing tongue 329 formed in sealing sleeve 321. Sealing tongue 329 is separated from the rest of sealing sleeve 321 on one side by a slit 330, which runs in an essentially U-shaped manner. Sealing tongue 329 is connected to the rest of sealing sleeve 321 on the other side (at the bottom of the U). This ensures that sealing tongue 329 is able to lift the underside 397 of sealing surface 331 of non-return valve 335 (described further below) in the occurrence of a vacuum.

Passage 317, outlet 332, and passage 328 form flow channel 318 of lid 303. Flow channel 318 connects interior volume 333 of container 301 with atmosphere 334. Sealing tongue 329, along with sealing surface 331 and passage 328, forms non-return valve 335 of lid 303. When valve cover 312 is closed, collar 336 presses sealing sleeve 321 against the outer top edge of elevation 323, such that sealing sleeve 321 cannot lift away from elevation 323.

Furthermore, and as shown in FIG. 18, valve cover 312 has a sealing journal 337 that is aligned in a downward direction, with its pointed end 338 engaging with a conical recess 339 of sealing sleeve 321 to seal and thereby close a ventilation channel 340 in lid 303. When pointed end 338 of sealing journal 337 is engaged with conical recess 339, sealing journal 337 is laterally disposed relative to non-return valve 335. The combination of sealing journal 337 and conical recess 339 forms a ventilation valve 341. When valve cover 312 is moved about both bearing journals 311 in a clockwise direction, ventilation channel 340 is opened, and air from the outside is able to enter interior volume 333 of container 301. As a result, interior volume 333 of container 301 is no longer under vacuum. Prior to the ventilation process, when there is a vacuum in interior volume 333, sealing tongue 329 is pressed against sealing surface 331, such that non-return valve 335 is closed and may not be opened without intervention.

Figure 18A:
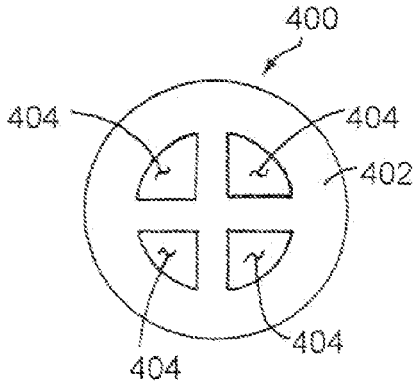
FIG. 18A is a top view of a vacuum sense opening of the container of FIGS. 13 and 18.

Ring-shaped elevation 325, which is disposed laterally relative to ventilation valve 341, is used as a guide for a pressure-indicating protrusion 342. Pressure-indicating protrusion 342 includes a bellows-like, one-piece diaphragm 343, which projects upward from sealing sleeve 321. Pressure-indicating protrusion 342 also includes a journal 344 at one end of diaphragm 343. Journal 344 extends through a bore 345 in valve cover 312, such that journal 344 is visible in valve cover 312. Pressure-indicating protrusion 342 is disposed over a vacuum sense opening 400, which is shown in greater detail in FIG. 18A, and which allows pressure indicating protrusion 342 to be in fluid communication with interior volume 333 of container 301. In the illustrated embodiment, vacuum sense opening 400 is formed by four holes 404 through a generally ring-shaped member 402, which is integrally formed with lid 303.

When there is an insufficient vacuum in interior volume 333 of container 301, journal 344 is extended completely in an upward direction. However, as a sufficient vacuum in generated in interior volume 333 of container 301 (when lid 303 is placed on container 301), diaphragm 343 contracts due to the pressure conditions, and journal 344 travels in a downward direction into bore 345, such that diaphragm 343 is barely visible from the outside (i.e., only the top 346 of journal 344 is still visible). At this point, an operator now knows that the correct vacuum has been achieved within container 301.

In some embodiments, journal 344 can include one or more colors. Journal 344 can be, for example, red. In certain embodiments, journal 344 can have a different color from the rest of container 301. Being colored can allow journal 344, when it is extended in an outward direction, to be relatively easily recognized on its peripheral side 398 and its top 346. Thus, pressure-indicating protrusion 342 may even more effectively signal to an operator that the vacuum in interior volume 333 of container 301 is no longer sufficient to store food for a relatively long period of time. Furthermore, in some instances, pressure-indicating protrusion 342 can acoustically signal to an operator that the pressure level within container 301 is no longer sufficient (e.g., by "popping out" and extending in an upward direction). Pressure indicating protrusions are described, for example, in a jointly owned patent application filed concurrently herewith, Vilalta et al., U.S. patent application Ser. No. 10/882,520, entitled "Food Storage Containers", which is hereby incorporated by reference in its entirety.

Referring especially now to FIGS. 13 and 18, a soft elastomer (preferably a plastic) is sprayed onto surface 320 of lid 303. The soft elastomer gives lid 303 a soft outer protective skin 347 that can, for example, allow lid 303 to be handled in a more secure manner, and that can give lid 303 enhanced protection against damage. Alternatively or additionally, protective skin 347 can make it easier for visual design features (e.g., a manufacturer logo) to be configured in lid 303.

FIG. 20 shows laterally flexible snap fingers 348, which extend downwardly from valve cover 312, and are disposed toward a side of the lid 303 opposite the side from which the lid 303 is lifted upward. As valve cover 312 is closed, snap fingers 348 snap into lateral cut-outs 350 of side wall 351 of recess 310 in lid 303. When snap fingers 348 snap into lateral cut-outs 350, they press sealing sleeve 321 (via collar 336 and sealing journal 337) against the bottom of recess 310. To open valve cover 312, an operator can use one finger to reach under a grip edge 354, which is located on the same side of container 301 as snap fingers 348, and tilt valve cover 312 in an upward direction about bearing journals 311.

Referring to FIG. 13, a conical connector 355 of a container evacuation pump 364 is sealingly inserted into cover sealing surface 315 of valve cover 312. Because connector 355 is conical and cover sealing surface 315 is frustoconical, connector 355 can be inserted into cover sealing surface 315 relatively easily. Connector 355 includes a connector control valve 358 (shown as a flapper valve) that includes unilateral, partially ring-shaped segments 356 and 357. While shown as a flapper valve, in some embodiments, connector control valve 358 can be in the form of another kind of valve, such as a slide valve or a ball valve. Connector control valve 358 can be made of, for example, one or more elastomeric and/or rubber materials. Connector control valve 358 can be integrally formed with the body of connector 355 (e.g., by a two-component injection molding process), or can be formed separately from the body of connector 355 and attached to the body of connector 355 thereafter (e.g., thereby allowing for relatively easy removal and replacement of connector control valve 358 from the connector body). The integral formation of connector control valve 358 and the body of connector 355 can be a relatively simple and/or inexpensive process.

When connector 355 is inserted into cover sealing surface 315, the free end of protrusion 319 extends into segments 356 and 357 of connector control valve 358, pressing both tongues 359 and 360 of connector control valve 358 apart. As a result, side passages 361 and 362 (shown in FIG. 17) are created, thereby opening a suction channel 363 of connector 355 that is in fluid communication with passage 317 and flow channel 318.

Figure 14:
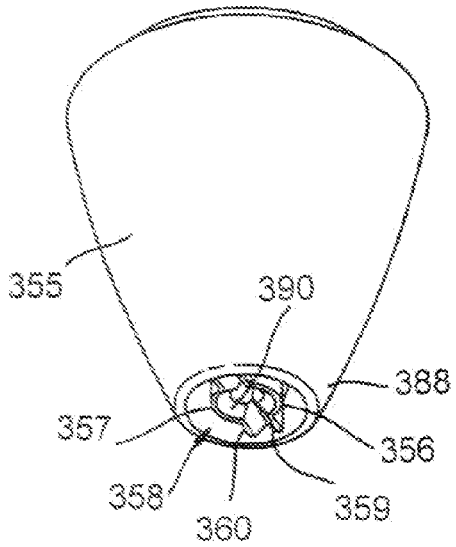
FIG. 14 is a perspective view of a connector of the device of FIG. 13.
Figure 15:
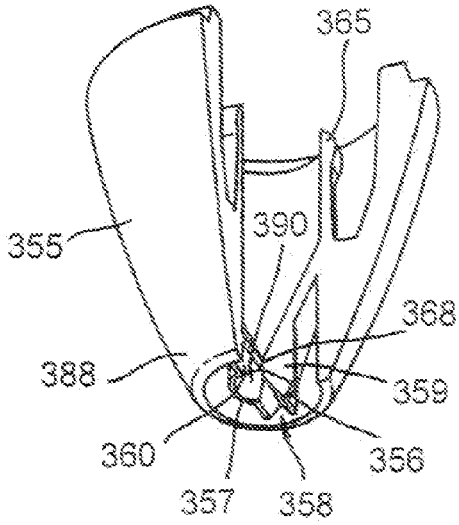
FIG. 15 is a cutaway view of the connector of FIG. 14.
Figure 17:
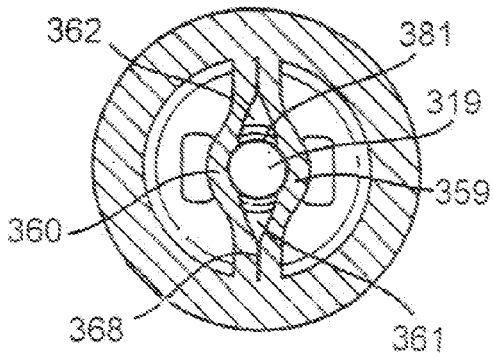
FIG. 17 is a bottom view of the coupling of the connector of FIGS. 14 and 15 with the protrusion of FIG. 16, taken along line 17-17 in FIG. 13.

FIGS. 14 and 15 show connector 355 in greater detail. Connector 355 is made of an elastomeric plastic that allows connector 355 to seal effectively. Connector 355 is fixedly clipped onto the free end of housing 370 of container evacuation pump 364 (FIG. 13). Elastic locking elements 365, which are formed on the inner wall of connector 355, lock (as a friction-fit) into recesses 367, which are formed on a tube-shaped connecting piece 366 of housing 370. Thus, locking elements 365 firmly connect connector 355 with housing 370 of container evacuation pump 364. Opposing tongues 359 and 360 extend from the inner wall of connector 355 and form connector control valve 358 (FIG. 17). When connector control valve 358 is closed, tongues 359 and 360 are pressed against one another at their sealing surfaces 368, such that side passages 361 and 362 are closed in a pressure-tight manner.

Figure 16:
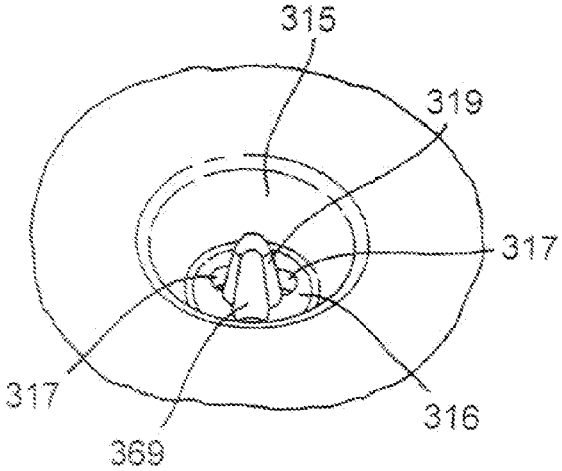
FIG. 16 is a top view of a protrusion of the container of FIG. 13.

As shown in FIG. 16, protrusion 319 has grooves 369 on its outer periphery that run in the longitudinal direction of protrusion 319. As shown in FIG. 17, grooves 369 provide for improved passage when connector control valve 358 is opened. In this context, both sealing surfaces 368 are separated from one another, and side passages 361 and 362 are formed.

FIG. 13 shows a partial illustration of housing 370 of container evacuation pump 364 and housing 373 of an electric drive unit 372. Housings 370 and 373 are attached to each other. Boundary 374 shows the transition from housing 370 to housing 373. Housings 370 and 373 house a rotor pump unit 394 (e.g., a vane pump), an electric motor 392, and drive shafts 391 and 393. Connector 355 is attached to housing 370. The design of container evacuation pump 364, which is not shown in the figures, includes lamina that are formed on a rotor and a laminated housing, as well as a valve device for regulating pressure. However, other container evacuation pumps can be used here, such as those described in U.S. Pat. No. 5,195,427 and in German Patent No. DE 100 60 996 C1, both of which are herein incorporated by reference. Rotor pump unit 394 of container evacuation pump 364 is formed in a space 371 surrounded by housing 370. In FIG. 13, drive unit 372 and housing 373 both are shown only in part. Drive unit 372 includes electric motor 392 and drive shaft 391, which is coupled to drive shaft 393 of container evacuation pump 364. Suitable drive units are known in the art.

Figure 19:
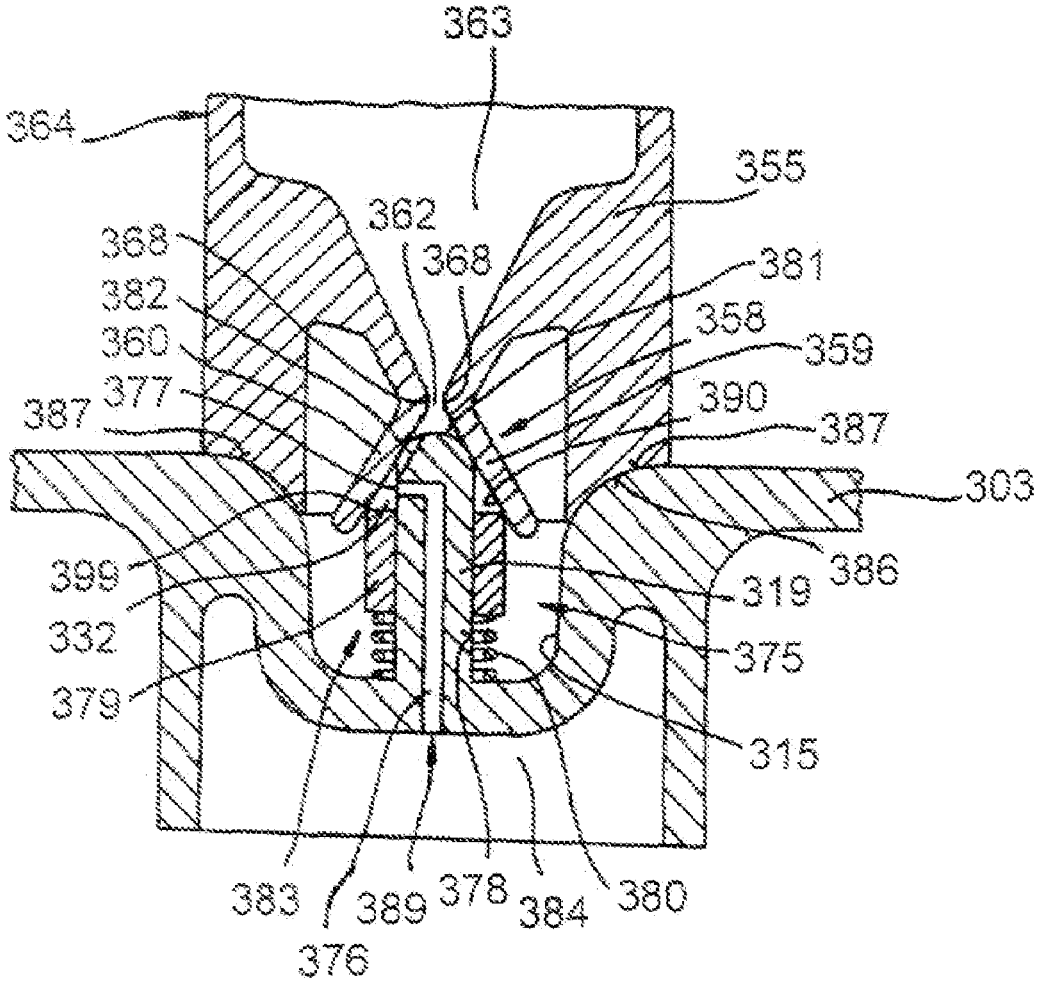
FIG. 19 is a cross-sectional side view of an embodiment of a portion of a food storage container coupling with the connector of FIGS. 14 and 15.

FIG. 19 shows an embodiment of a valve arrangement 375. In FIG. 19, as was the case with FIG. 13, connector control valve 358 is a part of connector 355 of container evacuation pump 364. However, one difference between FIG. 13 and FIG. 19 is that in FIG. 19, protrusion 319 is in the form of a cylinder that has a central bore 376. (Protrusion 319 can be formed, for example, by an injection-molding method.) Bore 376 forms a channel through the center of protrusion 319. Bore 376 exits protrusion 319 laterally at the free end of protrusion 319, forming an outlet 377. A bushing 379 is guided precisely over outer surface 378 of protrusion 319 and can glide over outer surface 378. Bushing 379 is disposed over a spring 380. Spring 380 can be, for example, a helical spring, a flat spring, or a rubber elastic spring. In some embodiments, spring 380 can be injection-molded onto bushing 379. Spring 380 can be attached to lid 303 or to the body of container 301 by, for example, adhesive bonding, gluing, screwing, or welding. When connector 355 of container evacuation pump 364 is lifted away from lid 303, spring 380 causes bushing 379 to move, and to thereby close outlet 377 of bore 376.

The free end of protrusion 319 forms a stop surface 381 for connector control valve 358. In some embodiments, connector control valve 358 can have be bevelled to allow for enhanced penetration of stop surface 381 between tongues 359 and 360. The free end of protrusion 319 includes a slit 382 that opens a flow path between suction channel 363 and bore 376 when connector 355 is coupled with protrusion 319 (as shown in FIG. 19). As shown, the location of slit 382 is restricted to only a portion of the free end of protrusion 319. Thus, to form side passage 362 (FIG. 17), connector 355 should be pressed against protrusion 319 (or vice versa) to sufficiently separate tongues 359 and 360 of connector 355 from each other. Side passage 362 allows for fluid communication in an upward direction between bore 376 and suction channel 363 of container evacuation pump 364. Movable bushing 379, together with bore 376 and protrusion 319, forms a protrusion control valve 383.

When connector 355 is placed on and pressed against valve arrangement 375, a flow channel 389 is formed. Flow channel 389 includes suction channel 363 of connector 355, side passage 362, slit 382, outlet 377, bore 376, and a channel segment 384 (which is directly under protrusion 319). At its free end, connector 355 includes a sealing surface 386. The sealing surface can be disposed on the distal face or side of connector 355, or as a tapered or curved surface as shown. As noted above, valve cover 312 has a cover sealing surface 315. At its top outlet, cover sealing surface 315 includes a peripheral sealing surface 387, which is used as a pressure-tight contact surface for sealing surface 386 of connector 355. In this context, both peripheral sealing surface 387 and sealing surface 386 are formed in a ring-shaped manner, such that they are flush when they contact each other.

As shown in FIG. 19, tongues 359 and 360 of connector 355 are pressed sufficiently far apart as to open side passage 362 (as was also the case in FIG. 17). At the same time, operating surface 390, formed on the inner surface of tongue 360, pushes bushing 379 in a downward direction via a ring-shaped corner 399 on bushing 379, such that outlet 377 is opened.

While stop surface 381 is shown as adjacent outlet 377 of flow channel 389, in some embodiments, the stop surface can be formed elsewhere (outside of the flow channel, on the container housing or on the cover). In such embodiments, connector control valve 358 may project outwardly such that it is directed toward the stop surface when the container evacuation pump is coupling with the container.

In some embodiments (not shown), rather than there being a protrusion 319 on lid 303, a depression can be formed at outlet 377 of flow channel 389. In such embodiments, control valve 358 can include a journal that engages with the depression when the container evacuation pump is positioned, so that control valve 358 is opened. Other arrangements of control valves and control valve openers are possible, as long as the control valve is opened when the container evacuation pump is placed on the valve arrangement. In some embodiments, electrically or magnetically operable means may be used to enable openings of the control valve.

The operation of the above-described container evacuation systems and corresponding vacuum pumps is described below with reference to FIG. 13.

As long as container evacuation pump 364 (including its drive unit 372) is not placed on non-return valve 335, lid 303 may be removed from or placed on container 301. However, if, for example, container 301 is closed by lid 303 after interior volume 333 of container 301 has been filled with food, then the system may be evacuated. For this purpose, connector 355 is inserted into outlet 385 of lid 303 (shown in FIG. 18) until sealing surface 388 of connector 355 (shown in FIGS. 14 and 15), which is conical, contacts cover sealing surface 315 in a sealing manner. In this context, protrusion 319 engages with partially ring-shaped segments 356 and 357 of tongues 359 and 360, and presses tongues 359 and 360 apart, such that sealing surfaces 368 of tongues 359 and 360 are partially separated from each other, thereby forming side passages 361 and 362. In this position, non-return valve 335 is still closed, since there is atmospheric air in interior volume 333 of container 301, as well as outside of container 301.

The conical form of sealing surface 388 can allow for relatively easy insertion of container evacuation pump 364 into cover sealing surface 315 (even, for example, when the operator exerts only a light pressure on container evacuation pump 364). However, other configurations are possible for sealing surface 388, as long as sealing surface 388 and cover sealing surface 315 are shaped so as to form an effective seal together. In some embodiments, sealing surface 388 can have an oval cross-section.

Sealing surface 388 and cover sealing surface 315 can be made of any of a number of different materials. In some embodiments, sealing surface 388 and cover sealing surface 315 can both be made of one or more elastomeric materials (that are the same as, or different from, each other). The elastomeric materials can enhance the integrity of the seal between sealing surface 388 and cover sealing surface 315 (e.g., because of the deformability of the elastomeric materials). In certain embodiments, the elastomeric material can be sprayed onto the container evacuation pump, the container housing, and/or the cover such that it bonds to them. Alternatively or additionally, elastomeric parts (such as sealing surface 388 and cover sealing surface 315) can be formed from one or more elastomers in a separate operation (e.g., by a molding process), and attached to the container evacuation pump, the container housing, and/or the cover thereafter (e.g., by clipping, screwing, or bonding).

When drive unit 372 is activated by an electric circuit (not shown), drive shaft 391 of electric motor 392 rotates, driving drive shaft 393 of rotor pump unit 394. Rotor pump unit 394 promotes a vacuum, in that rotor pump unit 394 attempts to suction air out of interior volume 333 of container 301. As soon as the pressure above the non-return valve 335 has sufficiently decreased (as a result of the resulting vacuum in suction channel 363), non-return valve 335 opens (i.e., sealing tongue 329 lifts away from sealing surface 331). Once non-return valve 335 has opened, air flows from interior volume 333 of container 301, through flow channel 318 of lid 303 (which is formed by passage 328, outlet 332, passage 317, side passages 361 and 362, and suction channel 363), to container evacuation pump 364, where the air is pumped into atmosphere 334. This process is maintained until a predefined vacuum results in interior volume 333 of container 301. As soon as a predefined vacuum has been reached in interior volume 333, a pressure control valve (not shown) formed in container evacuation pump 364 opens to keep the pressure in interior volume 333 constant. Because the predefined vacuum can be achieved in interior volume 333 of container 301, the walls of lid 303 and container 301 can, for example, be dimensioned to be only as thick as is necessary for the predefined pressure level (within a relatively low tolerance). As a result, material costs can be saved, without simultaneously requiring a sacrifice in the lifespan of container 301 and/or lid 303.

A pressure display device formed on container evacuation pump 364 can be used to show an operator that the predetermined pressure has been reached within interior volume 333 of container 301, thereby notifying the operator that container evacuation pump 364 can be deactivated and removed from non-return valve 335. As soon as container evacuation pump 364 is deactivated, non-return valve 335 closes, thereby closing flow channel 318 of lid 303 with respect to atmosphere 334. The operator can then remove connector 355, complete with container evacuation pump 364 and connected drive unit 372, from lid 303, without the air from atmosphere 334 being able to penetrate interior volume 333 of container 301. The air from atmosphere 334 also cannot penetrate interior volume 333 because ventilation valve 341 is securely closed. Furthermore, lid 303 and sealing ring 306 are firmly and sealingly pressed against edge 302 of container 301, as a result of the vacuum force formed in interior volume 333 of container 301.

During the evacuation procedure, diaphragm 343 contracts, such that journal 344 glides into bore 345. Thus, only the top 346 of journal 344 is still visible from above. This also indicates to an operator that the correct pressure has been reached in interior volume 333 of container 301. Food may now be stored in this manner under a predetermined vacuum for a relatively long period of time.

When connector 355 is removed from non-return valve 335, protrusion 319 slides out of operating surface 390, so that connector control valve 358 closes again (i.e., sealing surfaces 368 return to having a common contact surface, such that they are flush with each other).

The configuration of container evacuation pump 364 can allow for a relatively quick evacuation of container 301. For example, a container may be evacuated to a predetermined pressure level within a matter of seconds.

To remove food from interior volume 333 of container 301, an operator can reach with, for example, a finger or a thumb, under grip edge 354, and tilt valve cover 312 in a clockwise direction about bearing journals 311, until pointed end 338 of sealing journal 337 lifts away from the sealing surface of conical recess 339. When this happens, atmospheric air flows into interior volume 333 of container 301 via ventilation channel 340. In some embodiments, the entrance of atmospheric air into interior volume 333 results in the development of hissing noises. The operator may only have to exert a relatively low force to open valve cover 312, as a result of the lever-like configuration and the relatively small sealing surface. Once atmospheric air is again within interior volume 333 of container 301, lid 303 may be removed from container 301 without exerting substantial force, since there is no longer a substantial closing force between sealing ring 306 and edge 302 of container 301.

The primary difference between the operation of valve arrangement 375 (FIG. 19) and the operation of valve arrangement 349 (FIG. 13) is in the positioning of connector 355. In the case of both valve arrangements, when connector 355 is positioned, protrusion 319 opens connector control valve 358. In the case of valve arrangement 375, ring-shaped corner 399 on bushing 379 is simultaneously pushed down against the force of spring 380 as a result of operating surfaces 390, which are formed on tongues 359 and 360. The pushing down of bushing 379 causes bushing 379 to move, thereby opening outlet 377 so that hydraulic communication is established between flow channel 389 and suction channel 363, and air can be withdrawn from interior volume 333 of container 301, which is located below channel segment 384 in FIG. 19. When connector 355 is later removed from valve arrangement 375, the procedure as described above is simply executed in reverse.

Valve arrangement 375 can have the advantage of being particularly simple to produce, while also functioning reliably. For example, the components of valve arrangement 375 can be formed of plastic, and can be produced by a relatively simple injection-molding process (e.g., so that they can slide relative to one another, which a close fit).

While the above-described valve arrangements have been shown as part of lid 303, in some embodiments, the valve arrangements can be located elsewhere. For example, the valve arrangement can be located on the container body (e.g., the valve arrangement can be a part of the container housing). In some embodiments, the valve arrangement can be located on an attachment to the container housing (e.g., on an attachment that projects horizontally from the container housing).

One or more of the above-described container evacuation systems can generate a pressure level within a container that is, for example, about 80 percent±five percent lower than atmospheric pressure (e.g., a pressure level of about 0.2 bar±0.05 bar).

While vacuum pump attachments with sealing lips have been described, in some embodiments, a cover (such as covers 7 and 312 described above) can alternatively or additionally have a sealing lip. The sealing lip on the cover can aid, for example, in the coupling of the cover with a vacuum pump attachment.

A number of embodiments of the invention have been described. Nevertheless, it will be understood that various modifications may be made without departing from the spirit and scope of the invention. Accordingly, other embodiments are within the scope of the following claims.

What is claimed is:

1. A food storage container comprising:

a lid defining a vent hole and a ventilation channel therethrough;

a removable cover removably secured to the lid to cover the vent hole, the cover defining an evacuation hole therethrough;

disposed between the vent hole and the evacuation hole, a one-way air valve that, when the cover is secured to the lid, allows air flow from the container and inhibits air flow into the container through the vent hole; and wherein the cover comprises a sealing journal that closes the ventilation channel when the cover is secured to the lid and does not close the ventilation channel when the cover is removed from the lid, so that air can flow into the container through the ventilation channel when the cover is removed from the lid.

2. The food storage container of claim 1, wherein the one-way air valve allows bi-directional air flow through the vent hole when the cover is not secured to the lid.

3. The food storage container of claim 1, wherein an outer surface of the cover defines a smooth sealing area extending about the evacuation hole for sealing against a vacuum pump held against the cover over the evacuation hole to evacuate the container.

4. The food storage container of claim 1, wherein the one-way air valve comprises a sealing tab.

5. The food storage container of claim 4, wherein the cover comprises a driving element having a first end and a second end, and wherein the first end is connected to the sealing tab, while the second end extends through the cover.

6. The food storage container of claim 5, wherein the second end of the driving element comprises a rim that is adapted to come into contact with a surface of the cover when the cover is lifted away from the lid.

7. The food storage container of claim 1, further comprising a sealing sleeve including a sealing tongue, wherein the sealing sleeve is disposed between the cover and the lid when the cover is secured to the lid.

8. The food storage container of claim 7, wherein the sealing tongue closes the vent hole when the cover is secured to the lid.

9. The food storage container of claim 7, wherein the lid further defines a ventilation channel.

10. The food storage container of claim 9, wherein the ventilation channel is disposed beneath a conical recess defined by the sealing sleeve when the cover is secured to the lid.

11. The food storage container of claim 9, further comprising a pressure-indicating protrusion extending through a bore in the cover.

12. The food storage container of claim 11, wherein the pressure-indicating protrusion comprises a one-piece diaphragm.

13. The food storage container of claim 12, wherein the pressure-indicating protrusion further comprises a pressure-indicating plug at one end of the one-piece diaphragm.

14. The food storage container of claim 1, wherein the one-way air valve comprises a flapper valve.

15. The food storage container of claim 1, further comprising a pressure indicator disposed in a recess defined by the lid, and extending through an opening in the cover.

16. The food storage container of claim 15, wherein the pressure indicator comprises a dome-shaped membrane.

17. The food storage container of claim 16, wherein the dome-shaped membrane comprises a resilient layer disposed on an interior surface of the membrane.

18. The food storage container of claim 16, wherein the pressure indicator comprises a plastic resin selected to maintain dimensional stability of the membrane over a temperature range of between −40° C. and 100° C.

19. The food storage container of claim 1, wherein the lid and the cover are integrally joined to each other.

20. The food storage container of claim 1, wherein the lid is connected to the cover by a hinge.

21. The food storage container of claim 20, wherein the hinge comprises a film hinge.

22. A method for evacuating a food storage container, comprising:

removing a blending attachment from a handheld electric appliance having an electric motor operable to a drive a shaft;

attaching a vacuum pump attachment to the handheld electric appliance such that the shaft is mechanically coupled to a drive of the vacuum pump to pump air, the vacuum pump comprising a housing with a rim about an air inlet;

coupling the vacuum pump to a food storage container comprising:

a lid defining a vent hole and a ventilation channel therethrough;

a removable cover removably secured to the lid to cover the vent hole, the cover defining an evacuation hole therethrough;

disposed between the vent hole and the evacuation hole, a one-way air valve that, when the cover is secured to the lid, allows air flow from the container and inhibits air flow into the container through the vent hole; and wherein the cover comprises a sealing journal that closes the ventilation channel when the cover is secured to the lid and does not close the ventilation channel when the cover is removed from the lid, so that air can flow into the container through the ventilation channel when the cover is removed from the lid;

wherein coupling is performed by placing the rim of the vacuum pump against an outer surface of the storage container, about the evacuation hole;

activating the vacuum pump to evacuate air from the container through the one-way air valve; and removing the vacuum pump from the container.

23. The method of claim 22, wherein placing the rim of the vacuum pump housing against an outer surface of the storage container comprises placing the rim of the vacuum pump housing against the cover.

24. The method of claim 22, wherein the vacuum pump attachment is attached to the handheld electric appliance before the vacuum pump is activated.

25. A food storage container comprising:

a lid defining a vent hole therethrough;

a removable cover removably secured to the lid to cover the vent hole, the cover defining an evacuation hole therethrough;

disposed between the vent hole and the evacuation hole, a one-way air valve that, when the cover is secured to the lid, allows air flow from the container and inhibits air flow into the container through the vent hole; and a sealing sleeve including a sealing tongue, wherein the sealing sleeve is disposed between the cover and the lid when the cover is secured to the lid.

26. The food storage container of claim 25, wherein the sealing tongue closes the vent hole when the cover is secured to the lid.

27. The food storage container of claim 25, wherein the one-way air valve allows bi-directional air flow through the vent hole when the cover is not secured to the lid.

28. The food storage container of claim 25 wherein the lid further comprises a ventilation channel and the cover further comprises a sealing journal that closes the ventilation channel when the cover is secured to the lid and does not close the ventilation channel when the cover is removed from the lid, so that air can flow into the container through the ventilation channel when the cover is removed from the lid.

29. The food storage container of claim 25, wherein an outer surface of the cover defines a smooth sealing area extending about the evacuation hole for sealing against a vacuum pump held against the cover over the evacuation hole to evacuate the container.

30. The food storage container of claim 25, wherein the one-way air valve comprises a sealing tab and the cover comprises a driving element having a first end and a second end, and wherein the first end is connected to the sealing tab, while the second end extends through the cover.

31. The food storage container of claim 30, wherein the second end of the driving element comprises a rim that is adapted to come into contact with a surface of the cover when the cover is lifted away from the lid.

32. The food storage container of claim 25 further comprising a pressure-indicator.

33. The food storage container of claim 25, where in the lid and the cover are integrally joined to each other.

34. The food storage container of claim 25, wherein the lid is connected to the cover by a hinge.

35. A food storage container comprising:

a lid defining a vent hole therethrough;

a removable cover removably secured to the lid to cover the vent hole, the cover defining an evacuation hole therethrough;

disposed between the vent hole and the evacuation hole, a one-way air valve that, when the cover is secured to the lid, allows air flow from the container and inhibits air flow into the container through the vent hole; and a pressure indicator disposed in a recess defined by the lid, and extending through an opening in the cover.

36. The food storage container of claim 35, wherein the one-way air valve allows bi-directional air flow through the vent hole when the cover is not secured to lid.

37. The food storage container of claim 35, wherein the lid further comprises a ventilation channel and the cover further comprises a sealing journal that closes the ventilation channel when the cover is secured to the lid and does not close the ventilation channel when the cover is removed from the lid, so that air can flow into the container through the ventilation channel when the cover is removed from the lid.

38. The food storage container of claim 35, wherein an outer surface of the cover defines a smooth sealing area extending about the evacuation hole for sealing against a vacuum pump held against the cover over the evacuation hole to evacuate the container 65.

39. The food storage container of claim 35, wherein the one-way air valve comprises a sealing tab and the cover comprises a driving element having a first end and a second end, and wherein the first end is connected to the sealing tab, while the second end extends through the cover.

40. The food storage container of claim 39, wherein the second of the driving element comprises a rim that is adapted to come into contact with a surface of the cover when the cover is lifted away from the lid.

41. The food storage container of claim 35, further comprising a sealing sleeve including a sealing tongue, wherein the sealing sleeve is disposed between the cover and the lid when the cover is secured to the lid and wherein the sealing tongue closes the vent hole when the cover is secured to the lid.

42. The food storage container of claim 35, further comprising a pressure-indicator.

43. A method for evacuating a food storage container, comprising:

removing a blending attachment from a handheld electric appliance having an electric motor operable to drive a shaft;

attaching a vacuum pump attachment to the handheld electric appliance such that the shaft is mechanically coupled to a drive of the vacuum pump to pump air, the vacuum pump comprising a housing with a rim about an air inlet;

coupling the vacuum pump to a food storage container comprising:

a lid defining a vent hole therethrough;

a removable cover removably secured to the lid to cover the vent hole, the cover defining an evacuation hole therethrough;

disposed between the vent hole and the evacuation hole, a one-way air valve that, when the cover is secured to the lid, allows air flow from the container and inhibits air flow into the container through the vent hole; and a sealing sleeve including a sealing tongue, wherein the sealing sleeve is disposed between the cover and the lid when the cover is secured to the lid;

wherein the coupling comprising placing the rim of the vacuum pump housing against an outer surface of the storage container, about the evacuation hole;

activating the vacuum pump to evacuate air from the container through the one-way valve; and removing the vacuum pump from the container.

44. The method of claim 43, wherein placing the rim of the vacuum pump housing against an outer surface of the storage container comprises placing the rim of the vacuum pump housing against the cover.

* * * * *